United States Patent [19]

Otoshima et al.

[11] Patent Number: 4,928,476

[45] Date of Patent: May 29, 1990

[54] TWO-FOR-ONE TWISTING MACHINE

[75] Inventors: Hiroo Otoshima, Shiga; Hiroshi Tsuji, Joyo; Shigeki Mori, Ohtsu; Yoshihiro Nishimura, Nagaokakyo, all of Japan

[73] Assignee: Murata Kikai Kabushiki Kaisha, Kyoto, Japan

[21] Appl. No.: 220,733

[22] Filed: Jul. 18, 1988

[30] Foreign Application Priority Data

Jul. 22, 1987 [JP] Japan ..... 62-182602

[51] Int. Cl.[5] ..... D01H 9/10; D01H 9/18; B65H 67/04

[52] U.S. Cl. ..... 57/268; 57/266; 57/270; 57/281; 242/35.5 A

[58] Field of Search ..... 57/266, 268–271, 57/276, 279, 281; 242/35.5 R, 35.5 A

[56] References Cited

U.S. PATENT DOCUMENTS

| | | | |
|---|---|---|---|
| 3,316,698 | 5/1967 | Franzen | 57/271 |
| 3,360,915 | 1/1968 | Franzen | 57/266 X |
| 3,370,412 | 2/1968 | Franzen et al. | 57/270 |
| 3,410,079 | 11/1968 | Franzen | 57/266 |
| 3,599,413 | 8/1971 | Nimtz et al. | 57/270 X |
| 3,729,915 | 5/1973 | Mayer et al. | 57/270 X |

*Primary Examiner*—John Petrakes

*Attorney, Agent, or Firm*—Spensley Horn Jubas & Lubitz

[57] ABSTRACT

A two-for-one twisting machine comprising a plurality of two-for-one twisting units arranged in rows, the two-for-one twisting units each consisting of a twisting machine and a take-up device, wherein there is provided a travelling member adapted to travel in front of such plural two-for-one twisting units, the travelling member being provided with a feed package changing means and a take-up package changing means.

18 Claims, 27 Drawing Sheets

TWO-FOR-ONE TWISTING MACHINE

FIELD OF THE INVENTION AND RELATED ART STATEMENT

The present invention relates to a two-for-one twisting machine.

Each two-for-one twisting unit of a two-for-one twisting machine comprises a twisting machine portion for giving twists to yarn while unwinding the yarn from a feed yarn package and a take-up device portion for taking up the yarn thus twisted.

In each such two-for-one twisting unit, when a take-up package becomes full-wound, this full-wound take-up package is discharged and an unloaded empty take-up tube is fed, while in the twisting machine portion, the feed package now in an empty condition is taken out and a new full-wound feed package is fed. In this case, the changing operations have heretofore been all performed by manual labor.

More particularly, according to the prior art, when a take-up package becomes full-wound, an operator first discharges the full-wound take-up package and supplies an empty take-up tube, then takes out the take-up tube of the feed package which has become empty and supplies a new full-wound feed package.

However, since the packages used in such two-for-one twisting machine are heavy and the spacing between adjacent two-for-one twisting units is narrow, both much labor and care are required for the operations, resulting in need of much time.

OBJECT AND SUMMARY OF THE INVENTION

It is an object of the present invention to provide a two-for-one twisting machine wherein a replacement of a take-up package and that of a feed package are automatically conducted at a time.

According to an embodiment of the invention there is provided a two-for-one twisting machine comprising a plurality of two-for-one twisting units arranged in rows, the two-for-one twisting units each consisting of a twisting machine and a take-up device, wherein there is provided a travelling member adapted to travel in front of such plural two-for-one twisting units, the travelling member being provided with a feed package changing means and a take-up package changing means.

When a take-up package becomes full-wound in a certain two-for-one twisting unit, the travelling member travels up to the position of the said two-for-one twisting unit, where feed and take-up packages are changed by the feed package changing means and the take-up package changing means, respectively.

BRIEF DESCRIPTION OF THE DRAWINGS

FIGS. 8 to 11 illustrate a tensor moving device, of which FIG. 8 is a perspective view, FIG. 9 is a plan view, partially in transverse section, FIG. 10 is a front view and FIG. 11 is a side view;

FIGS. 12 to 20 illustrate a package changing device, of which FIG. 12 is a perspective view, FIG. 13 is a plan view, FIG. 14 is a front view, FIG. 15 is a front view, partially in vertical section, showing a chuck mechanism, FIG. 16 is also a front view partially in vertical section, FIG. 17 is a side view, FIG. 18 is a detail view of portion A in FIG. 15, FIG. 19 is a schematic plan view for explaining the operation of the package changing device and FIG. 20 is also a schematic plan view;

FIGS. 21 to 23 illustrate a yarn end finding device, of which FIG. 21 is a plan view, FIG. 22 is a front view and FIG. 23 is a front view, partially in vertical section, of a yarn end finding mouth;

FIGS. 24 to 26 illustrate a full-wound package transfer device, of which FIG. 24 is a plan view, FIG. 25 is a side view and FIG. 26 is a plan view;

FIGS. 27 to 30 illustrate a yarn end moving device, of which FIG. 27 is a front view thereof wherein a yarn holding member is located in an upper position, FIG. 28 is also a front view with the yarn holding member located in a lower position, FIG. 29 is a plan view of the yarn holding member and FIG. 30 is a front view thereof;

FIGS. 32 and 33 illustrate a cradle arm moving device, of which FIG. 32 is a front view and FIG. 33 is a plan view showing a cradle arm opening member.

DETAILED DESCRIPTION OF PREFERRED EMBODIMENTS

Figure 3:
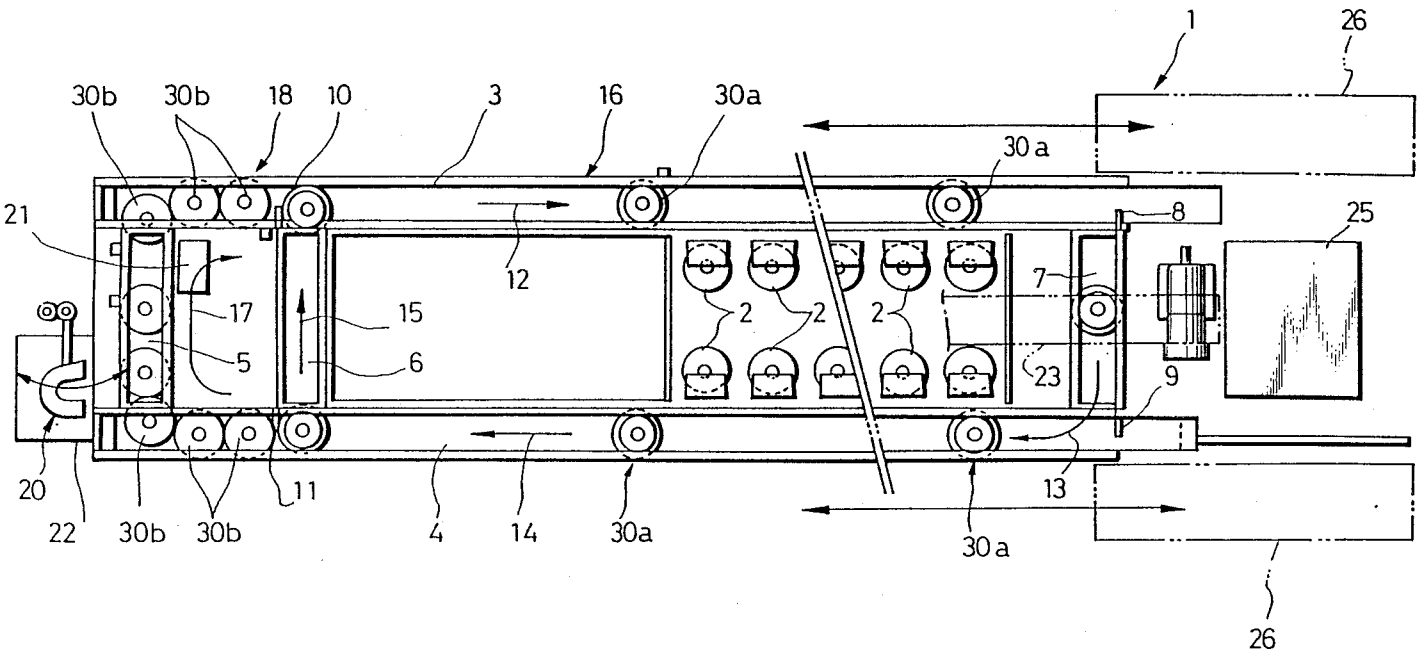
FIG. 3 is a plan view of a two-for-one twisting machine according to an embodiment of the present invention.
Figure 4:
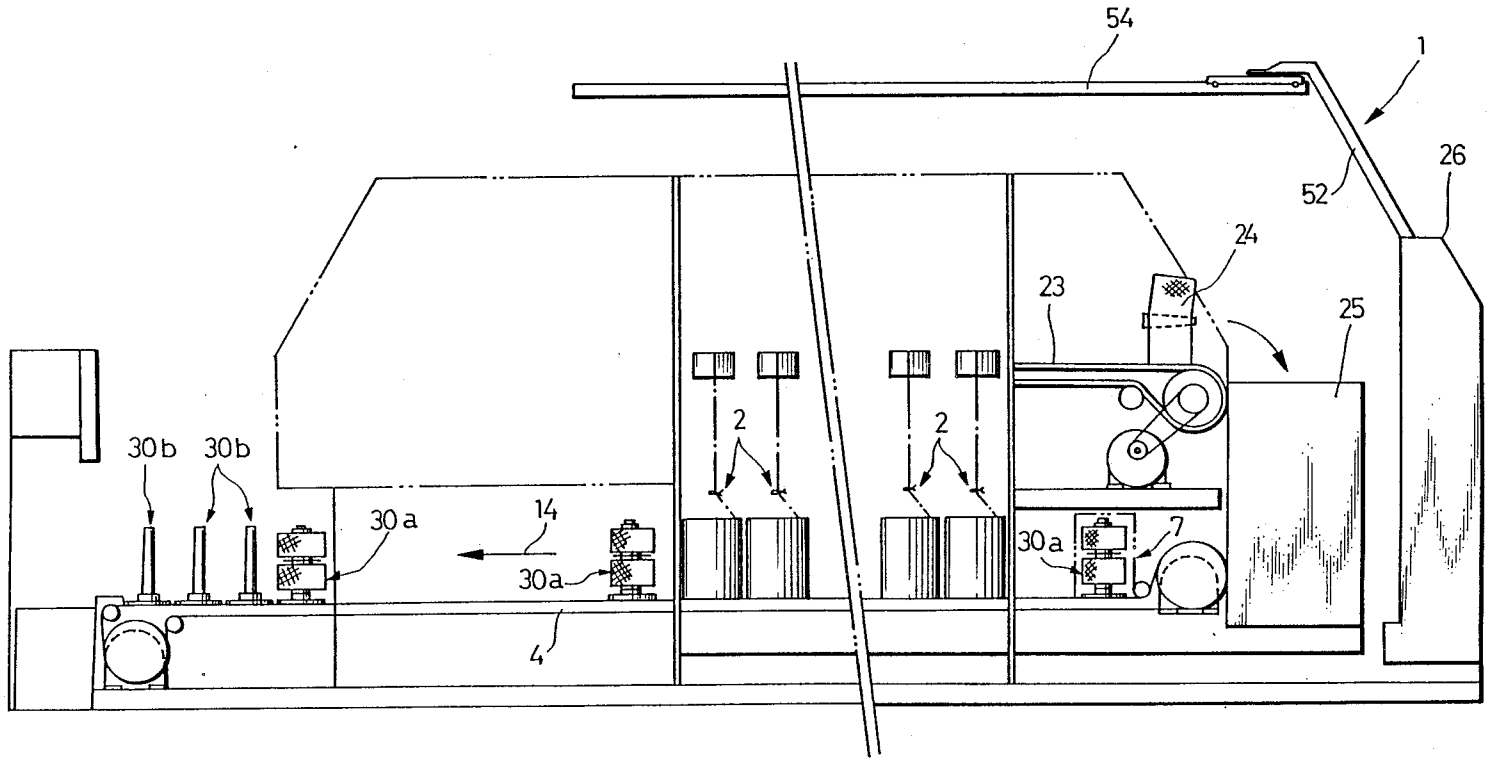
FIG. 4 is a front view thereof.

FIGS. 3 and 4 shows a two-for-one twisting machine 1 including an embodiment of the present invention. An outline of the two-for-one twisting machine 1 will now be explained. In the two-for-one twisting machine 1, a large number of two-stage feed type two-for-one twisting units (hereinafter referred to simply as unit or units) 2 are arranged in two rows back to back. Outside the rows of the units 2 thus arranged back to back there extend long conveyors 3 and 4 in two rows, and between the long conveyors 3 and 4 are installed short conveyors 5, 6 and 7 in positions which span those long conveyors. Further, stationary stoppers 8 and 9 are disposed in intersecting positions of the long conveyors 3, 4 and the short conveyor 7, and movable stoppers 10 and 11 are disposed in intersecting positions of the long conveyors 3, 4 and the short conveyor 6. The movable stoppers 10 and 11 take two positions selectively in one of which they project over the long conveyors 3 and 4 and in the other they are retracted from those long conveyors. Usually the movable stoppers 10 and 11 take their projecting positions over the long conveyors 3 and 4 to form both a circulation line 16 for transferring a transfer member in the directions of arrows 12, 13, 14 and 15 and an exchange line 18 for transferring the transfer member in the direction of arrow 17, which transfer member will be described below in detail. In FIGS. 3 and 4, the numerals 20, 21 and 22 denote a feed package changing device, a yarn end finding device and an empty bobbin receiving box, respectively; numeral 23 denotes a conveyor for a take-up package 24; numeral 25 denotes a take-up package receiving box; and numeral 26 denotes an automatic package changing machine adapted to reciprocate along the long conveyors 3 and 4.

Figure 5A:
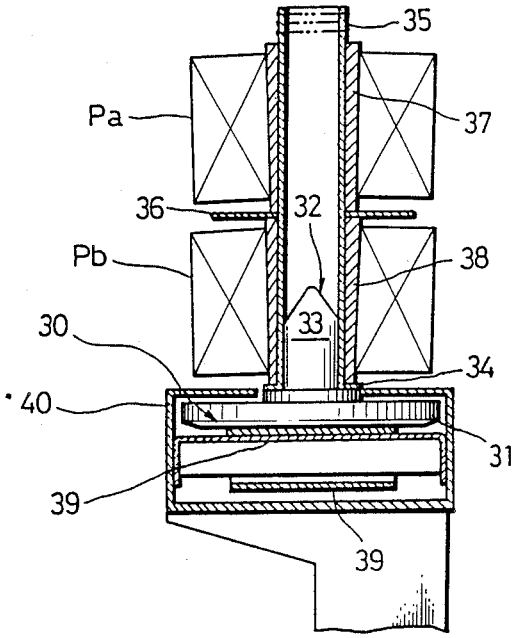
FIG. 5A is a sectional view showing a feed package on a tray.

FIG. 5A shows the aforementioned transfer article, which is composed of a conveyance medium (hereinafter referred to as "tray") 30 and feed packages Pa, Pb. The tray 30 comprises a disc 31 and an upwardly projecting portion 33 formed centrally of the disc 31 and having a conical upper end. A tubular guide pipe 35 having a ring-like pawl formed integrally at the lowest end thereof is fitted over the guide pipe 35. Further, a lower feed package Pb, an annular plate 36 and an upper feed package Pa are fitted on the guide pipe 35 successively from below. Numerals 37 and 38 represent take-up tubes of the feed packages Pa and Pb, respectively. The tray 30 is placed on a belt 30 and travels with movement of the belt. Numeral 40 denotes a conveyor frame which restricts the position of the tray 30 in both vertical and transverse directions.

Under the above construction, the tray 30 with the feed packages Pa and Pb and the tray 30 with only the take-up tubes 37 and 38 having no yarn wound thereon will hereinafter be referred to as a package feed tray 30*a* and an empty feed tray 30*b*, respectively.

Figure 5B:
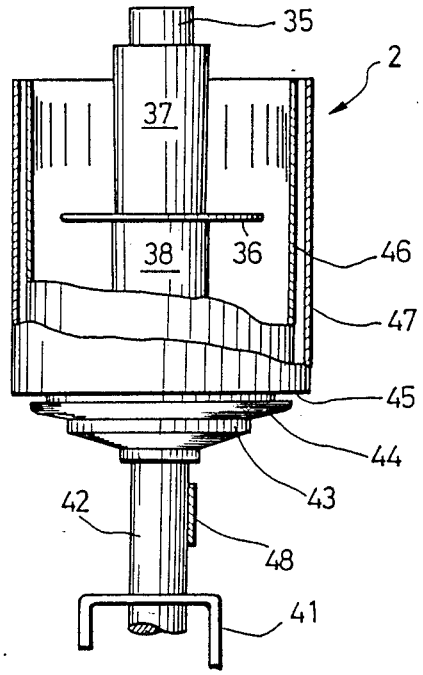
FIG. 5B is a front view showing an empty take-up tube in a two-for-one twisting unit.

In FIG. 5B there is illustrated a twisting portion 2 of a two-for-one twisting unit according to the present invention. The construction of the twisting portion 2 will now be explained briefly. A delay plate 43 and a rotary disc 44 are integrally fixed to a spindle 42 which is rotatably supported by a frame 41. Further, a stationary disc 45 is supported on the spindle 42 through a bearing. The stationary disc 45 maintains its stationary state by virtue of a magnetic attraction of a magnet (not shown). Onto the stationary disc 45 is fixed a cheese cover 46.

Further, a central cylinder is integrally fixed onto the stationary disc 45 and a guide pipe 35 is inserted thereinto. Numerals 47 and 48 denote a balloon cover and a belt, respectively.

In FIG. 3, the package feed tray 30*a*, circulating along the circulation line 16, is stopped forcibly in front of the unit 2 for which the feed packages Pa and Pb have been requested. Then, the feed package on the tray 30*a* and an empty feed package in the two-for-one twisting machine 2 are exchanged by the automatic package changing machine 26 and the empty feed package is fitted on the tray 30. The empty feed tray 30*b* leaves the circulation line 16 and enters the exchange line 18, where the empty package and the feed package are exchanged by the feed package changing device 20. After yarn ends of both feed packages Pa and Pb have been wound round the upper end of the guide pipe 35, the tray is again returned as the package feed tray 30*a* to the circulation line 16. The lower and upper feed packages Pb and Pa are fed to the feed package changing device 20 alternately distinguishedly. Thus, the feed packages Pa and Pb are fed successively by the changing device 20, whereby the lower and the upper feed package Pb and Pa are placed on the lower and the upper side, respectively.

Figure 1:
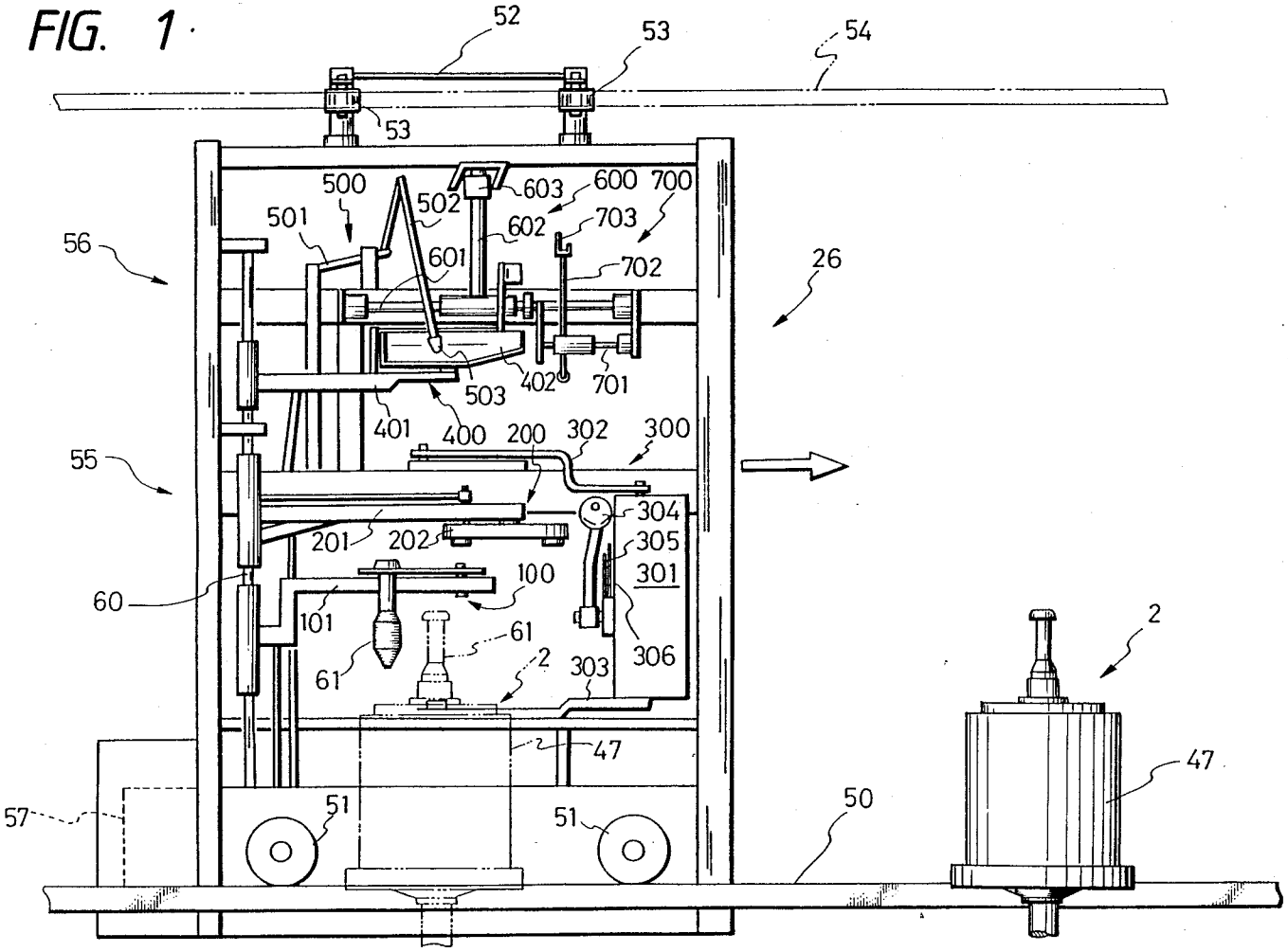
FIG. 1 is a front view of an automatic package changing machine relating to the present invention.
Figure 2:
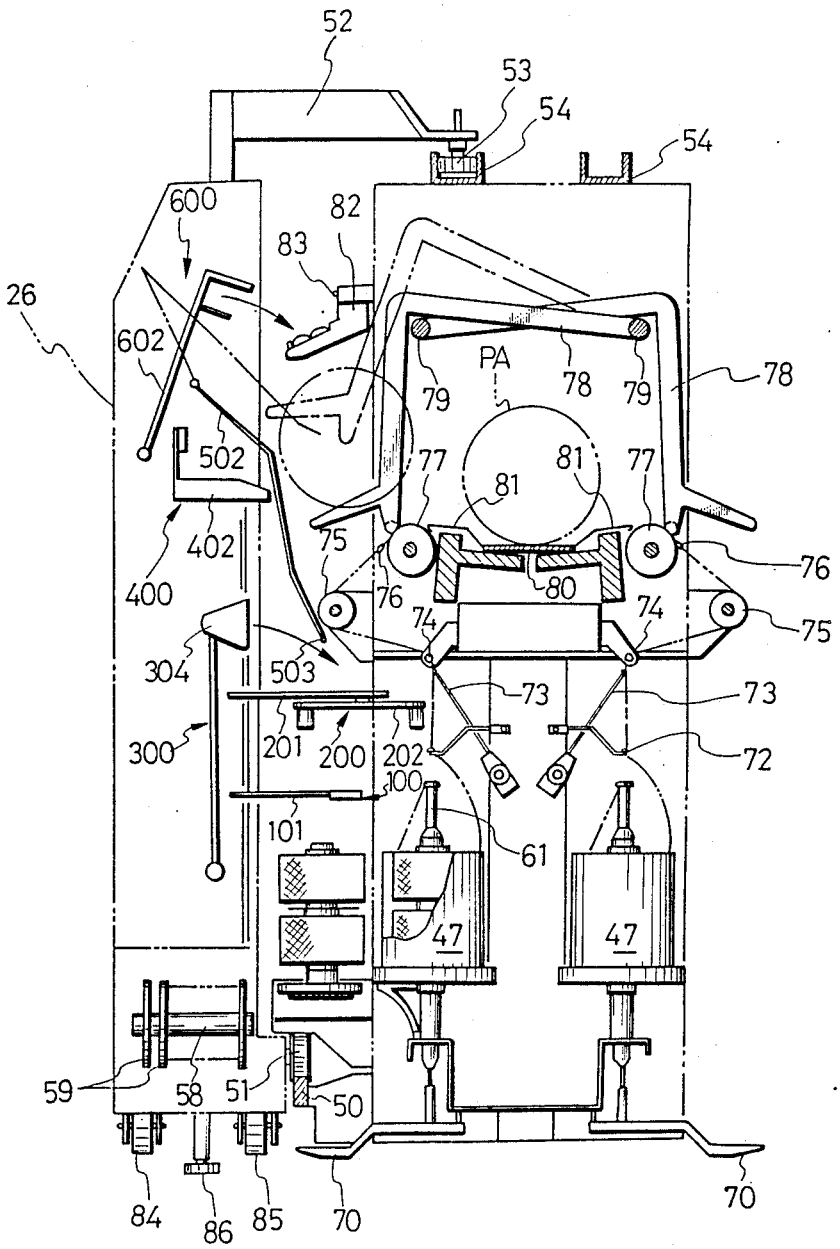
FIG. 2 is a side view thereof.

The construction of the automatic package changing machine 26 will now be outlined with reference to FIGS. 1 and 2. The automatic package changing machine (hereinafter referred to simply as the "automatic machine") 26 moves as wheels 51 rotate on a rail 50 disposed in front of the two-for-one twisting machine 1. Auxiliary rollers 53 are journalled on top of the automatic machine 26 rotatably through a bracket 52. The auxiliary rollers 53 travel along an auxiliary rail 54 disposed on top of the two-for-one twisting machine 1.

The automatic machine 26 is roughly divided into a feed package changing means 55 and a take-up package changing means 56 on the lower and the upper side of the machine frame, respectively. The feed package changing mean 55 comprises a tensor moving device 100, a package changing device 200 and a yarn end finding device 300, while the take-up package changing means 56 comprises a full wound package transfer device 400, a yarn end moving device 500, an empty take-up tube feeder 600 and a cradle arm moving device 700. All motions, except minute portions, of those devices are effected by rotation of plural cam plates 59 with rotation of a cam shaft 58 caused by operation of a motor 57. And those motions are performed under appropriate timing between the devices.

The function of each of the above devices will now be described briefly. Their detailed constructions will be explained later. In the tensor moving device 100, an arm 101 adapted to move up and down along a main rod 60 moves toward the two-for-one twisting machine (this direction will hereinafter be referred to simply as the "forward direction") and pulls or puts a tensor 61 of the unit 2 out of or into the unit. An empty feed package in the unit 2 and a wound feed package on the conveyor are exchanged by means of an exchange hand 202 attached to the front end of the arm 201 moving in the forward direction. In the yarn end finding device 300, the upper and the lower surface of a box 301 are supported by an upper arm 302 and a lower arm 303, respectively, and the box moves in the forward direction. A yarn end finding mouth 304 and yarn conveying levers 305 and 306 are supported on a side face of the box 301 tiltably through a shaft. A bunch winding of a new feed package is unwound by suction through the mouth 304 and a current of air is blown out to the spindle in the said feed package to let an end portion of the unwound yarn enter the spindle. The yarn conveying levers 305 and 306 are for upwardly moving the yarn which has gone out to the exterior through the spindle. A guide plate 402 is attached to an arm 401 adapted to move up and down along the main rod 60 and move in the forward direction, whereby a full-wound package is guided and carried out. In the yarn end moving device 500, a yarn holding member 503 is attached to the front end of an arm 502 attached to a pivotable rod 501. The yarn holding member 503 receives a yarn end of a bunch winding on the feed package at the lower portion of a feed roller 75 and conveys it up to the position of an empty take-up tube newly loaded on a cradle arm 78.

In the cradle arm moving device 700, a cradle arm opening member 703 is attached to the front end of an arm which is tiltable in the forward direction about a rod 701, whereby the cradle arm is opened to perform the discharge of a full-wound package and the loading of a new empty take-up tube.

In FIG. 2 there is schematically shown the entire construction of the two-for-one twisting unit 2. The unit 2 will now be explained briefly. Successively from below in FIG. 2, numerals 70, 47, 72 and 73 denote a foot plate, the foregoing balloon cover, a balloon guide and a drop wire, respectively. Yarn (Y) which has been twisted is wound onto a take-up package being rotated by a friction roller 77 through a yarn guide 74, a feed roller 75 and a traverse guide 76. The package is supported by the cradle arm 78 which is pivotable about a support shaft 79. Numeral 80 denotes a conveyor for full-wound take-up packages and numeral 81 denotes a guide for movement of each such package. Empty take-up tube each to be fed to the cradle arm 78 are stored in a stocker 82. Numeral 83 denotes a red lamp, which goes ON upon detection of movement of the cradle arm 78 when a take-up package becomes full-wound.

Feed and take-up packages are replaced with new packages in the following manner by means of the automatic machine 26.

In the unit 2 wherein the take-up package has become full-wound, the red lamp 83 goes ON and the travelling automatic machine 26 stops upon detection of lighting of the lamp 83. The full-wound package, indicated at PA, is discharged toward the conveyor 80 and conveyed up to an end portion of the machine frame by the conveyor 80. On the other hand, the tensor 61 is pulled out from the top of the old feed package by means of the tensor moving device 100, then the old feed package and a new feed package on the tray are exchanged by the changing device 200. Then, the bunch winding of the new feed package is unwound and thereafter the tensor 61 is again mounted to this package. Subsequently, the mouth 304 is positioned above the tensor 61 and the yarn end which has been sucked is blown out into the tensor 61. At this time, the foot pedal 70 is forced down by an arm (not shown) and there is performed a yarn passing operation through the package, with the yarn end being blown out upward from inside the balloon cover 47. The yarn end is then passed in engagement with the yarn guide 74 by means of the levers 305 and 306 and thereafter conveyed to a lower position of the feed roller 75. The yarn end is then conveyed up to the position of an empty take-up tube newly loaded to the cradle arm 78, by means of the yarn holding member 503 of the yarn end moving device 500. The said empty take-up tube has been conveyed to the cradle arm 78 from the stocker 82 by means of the empty take-up tube feeder 600. After the yarn end has been engaged with the empty take-up tube in the above manner, the operation of the double twisting unit 2 is started again.

After delivery of the full-wound take-up package through the operations described above, the new take-up tube supplying operation at the upper portion and the new feed package supplying operation at the lower portion are performed simultaneously in parallel, and after completion of both operations, the yarn end of the new feed package is conducted to the new take-up tube. Consequently, the preparation time required from the start of delivery of the full-loaded take-up package up to winding of twisted yarn onto the new take-up tube is shortened to a great extent.

Figure 6:
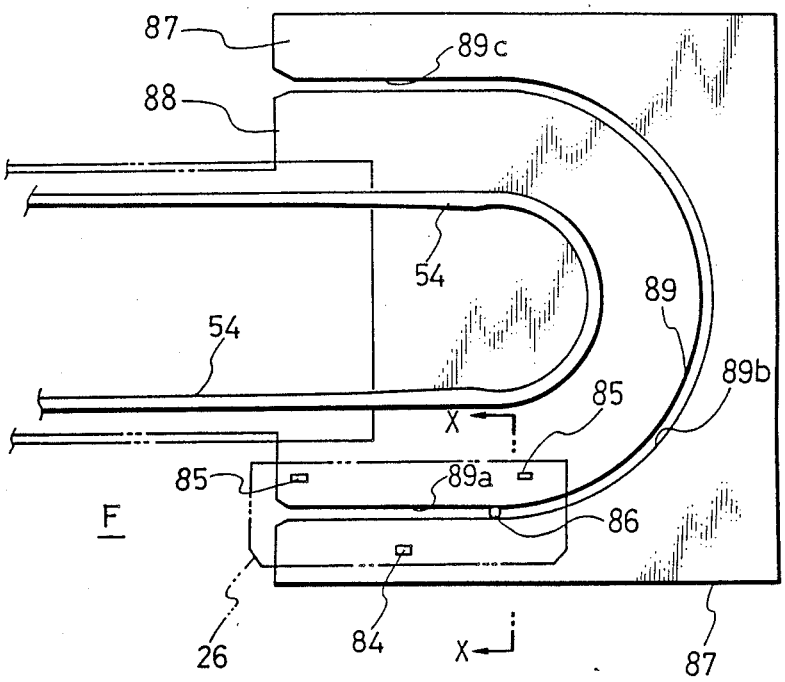
FIG. 6 is a plan view showing an end portion of the two-for-one twisting machine.
Figure 7:
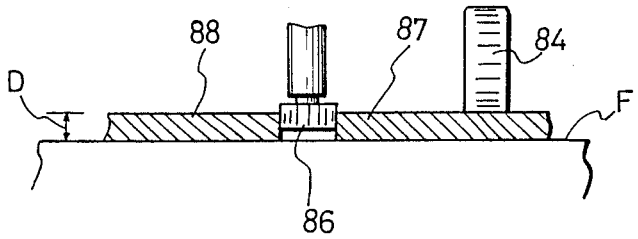
FIG. 7 is a sectional view taken on line VII—VII in FIG. 6.

In FIG. 2, on the underside of the automatic machine 26 are disposed a driving wheel 84, a driven wheel 85 and a rotatable guide roller 86 disposed in a lower position than both wheels. Further, travelling plates 87 and 88 are laid on the floor surface at an end portion of the two-for-one twisting machine 1, as shown in FIGS. 6 and 7. The plates 87 and 88, having a thickness D, are capable of abutting the wheels 84 and 85 and between the plates 87 and 88 there is formed a guide slot 89 to permit the guide roller 86 to get therein and come into rolling contact therewith. The guide slot 89 comprises rectilinear portions **89*a* and 89*c* and a curvilinear portion 89*b*, the curvilinear portion 89*b*** being arcuate.

The wheels 51 rotates on the rail 50 when the automatic machine 26 travels in front of the two-for-one twisting unit 2, but the rail 50 is disconnected at the foregoing end portion, where the automatic machine 26 travels through the driving wheel 84 on the travelling plates 87 and 88. In this case, the automatic machine 26 itself changes direction at this end portion because the guide roller 86 moves along the guide slot 89 in a restricted condition by the guide slot 89.

Since the curvilinear portion is constructed as above, the automatic machine 26 can travel even when a rail cannot be laid on the curvilinear portion. Further, since the automatic machine 26 moves while the guide roller 86 is always restricted by the guide slot 89, the automatic machine 26 is prevented from meandering such as getting inside or deflecting outside as it travels along the curve. Besides, it is not necessary to make a complicated steering control for the driving sheel 84, etc. Moreover, the automatic machine 26 may be travelled over a plurality of two-for-one twisting machines 1. For example, a traverser for conveying the automatic machine 26 may be provided at an end portion of the two-for-one twisting machine 1 to let the machine 26 cover a plural number of two-for-one twisting machines 1.

The construction of the tensor moving device 100 will be described below in detail with reference to FIGS. 8 to 11.

Figure 8:
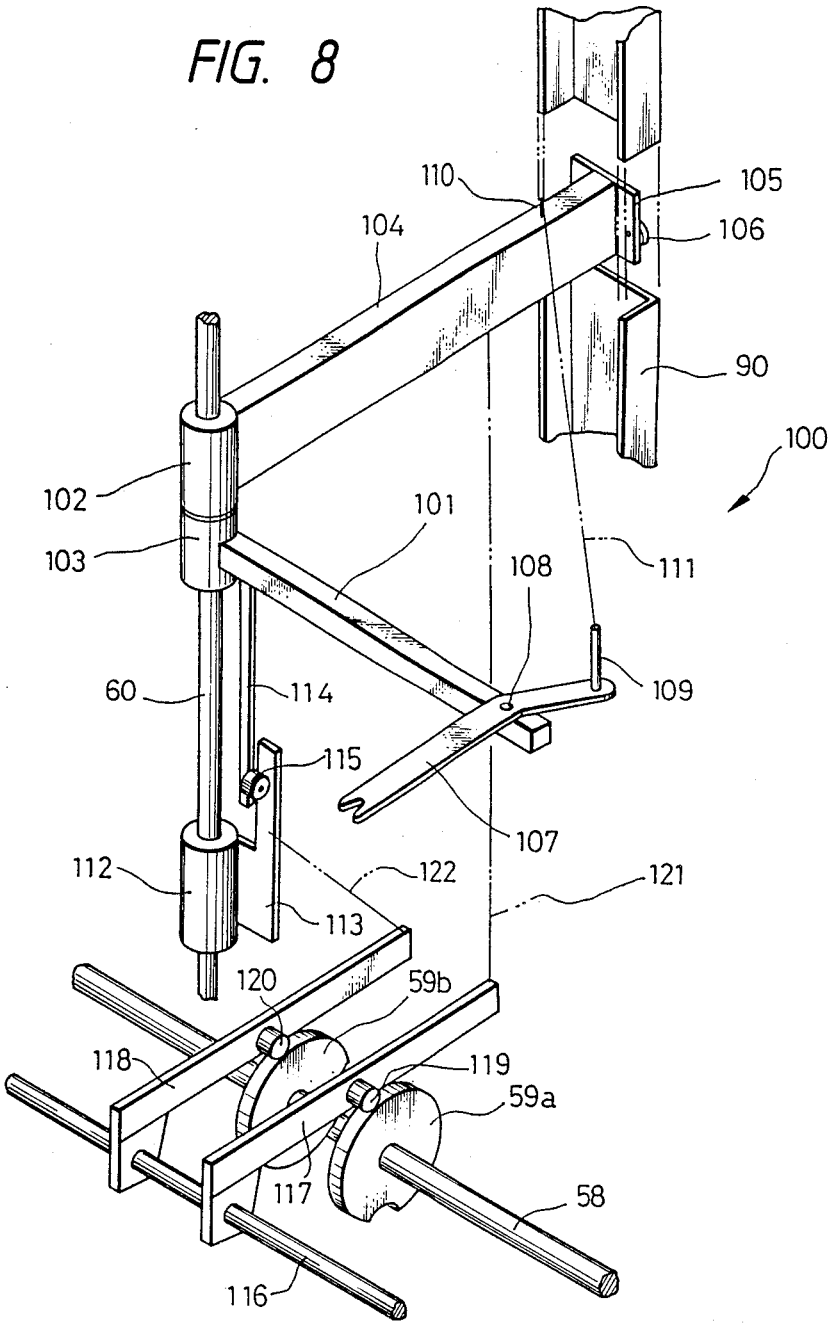

In FIG. 8, an upper cylindrical slider 102 and a lower cylindrical slider 103 are fitted on the main rod 60, the upper slider 102 being slidable vertically relative to the main rod 60 and the lower slider 103 also slidable vertically relative to the main rod 60 and rotatable. A support beam 104 is fixed to the upper slider 102, while at the other end of the support beam 104 a guide roller 106 is journalled rotatably through a bracket 105, the guide roller 106 being movable along the inner surface of a generally ]-shaped guide pillar 90 which is a component of the automatic machine 26. To the lower slider 103 is fixed the arm 101 in a direction perpendicular to the support beam 104 in plan view, and at the front end of the arm 101 a lever 107 is supported by a shaft 108. A pin 109 is fixed to the rear end of the lever 107 and both ends of a link arm 111 are pivotably supported by the pin 109 and a pin 110 of the support beam 104 respectively. Further, a cylindrical rotary slider 112 is fitted on the main rod 60 in a position below the lower slider 103, and an abutting plate 113 is fixed to the rotary slider 112. The abutting plate 113 can abut an abutting roller 115 supported by a shaft at the lower end of a depending plate 114 which is suspended from the base end portion of the arm 101.

In lower positions of the machine frame, cam plates **59*a* and 59*b* are fitted on the cam shaft 58 which is rotated by the motor 57, and cam followers 119 and 120 are journalled to levers 117 and 118 which are tiltable about a support shaft 116, the cam followers 119 and 120 being in abutment with the cam plates 59*a* and 59*b*, respectively. When the motor 57 is driven, the cam shaft 58 and the cam plates 59*a*, 59*b* rotate, causing the levers 117 and 118 to move up and down about the support shaft 116 according to the shape of the cam plates 59*a* and 59*b*. One lever 117 is connected to the support beam 104 through a rod 121, while the front end of the other lever 118 is connected to the abutting plate 113 through a rod 122. Consequently, with vertical movement of the front end of the lever 117, the support beam 104 and hence the arm 101 moves vertically, while with vertical movement of the front end of the lever 118, the abutting plate 113 can turn relative to the main rod 60 and hence the arm 101 can turn relative to the main rod 60 under abutment of the abutting plate 113 and the abutting roller 115. With such pivotal motion of the arm 101, the position of the lever 107 relative to the arm 101 also changes under the action of a link mechanism of the arm 101, lever 107 and link arm 111. More specifically, when the arm 101 pivots in the clockwise direction from its state shown in FIG. 9, the lever 107 pivots in the counterclockwise direction about the shaft 108, that is, it advances toward the two-for-one twisting unit 2**.

Figure 9:
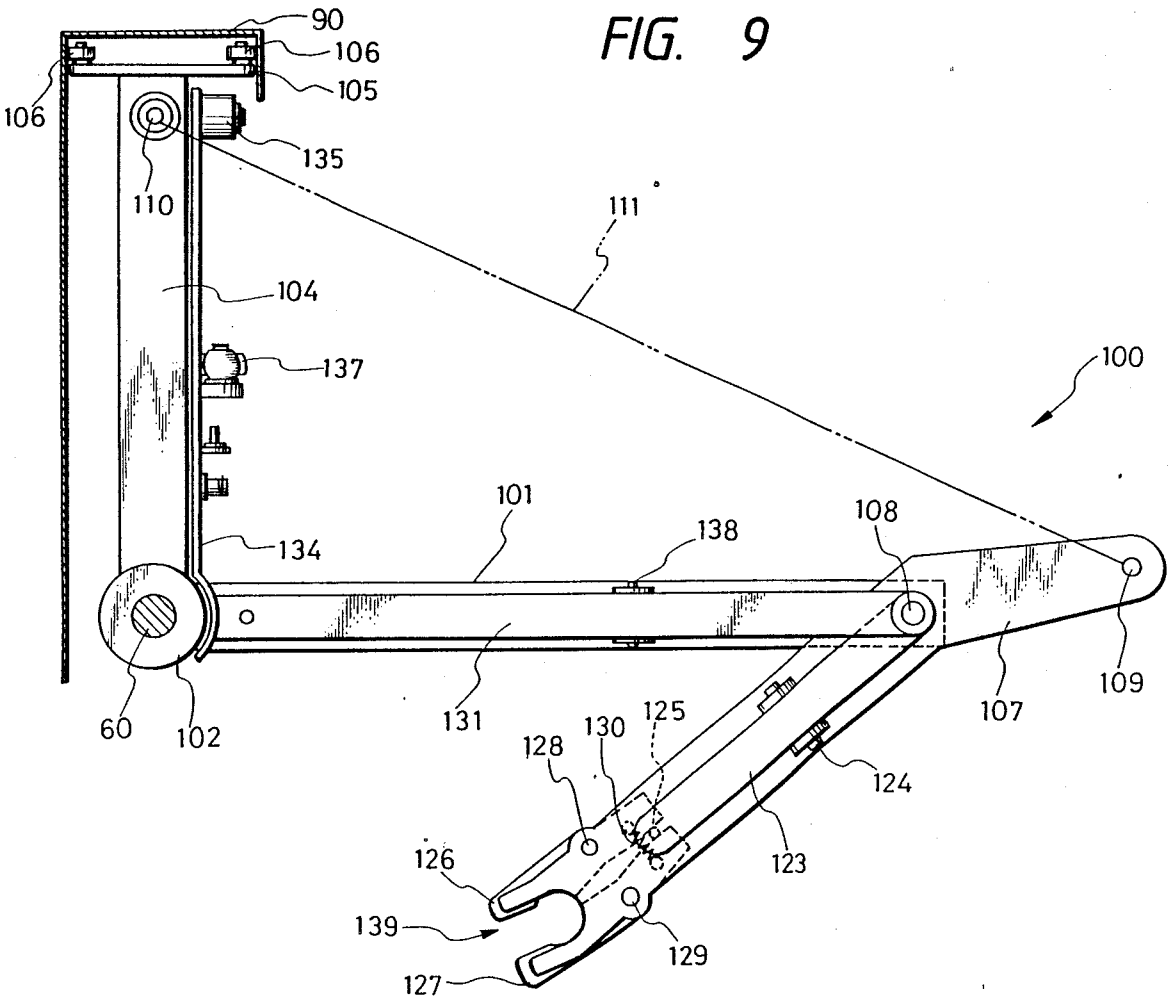
Figure 10:
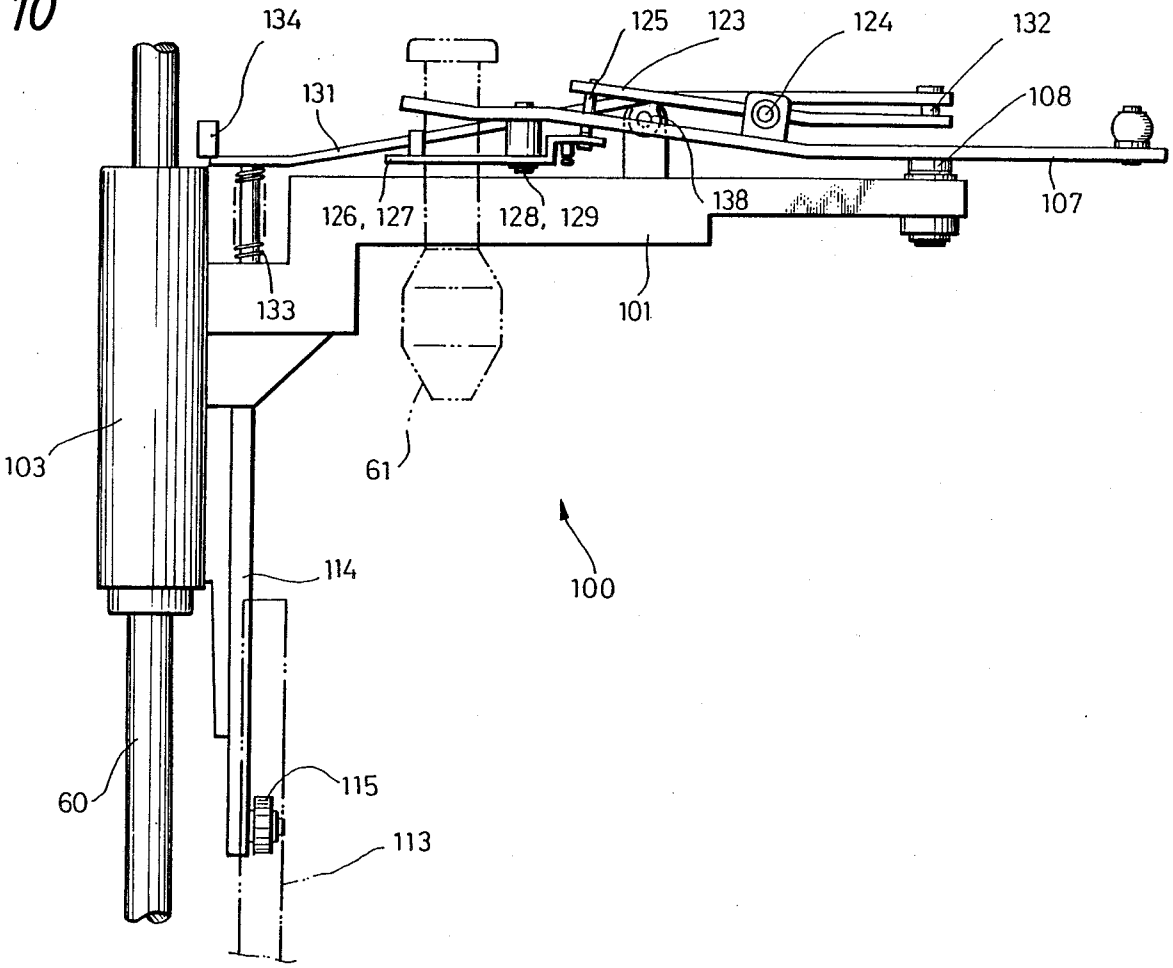
Figure 11:
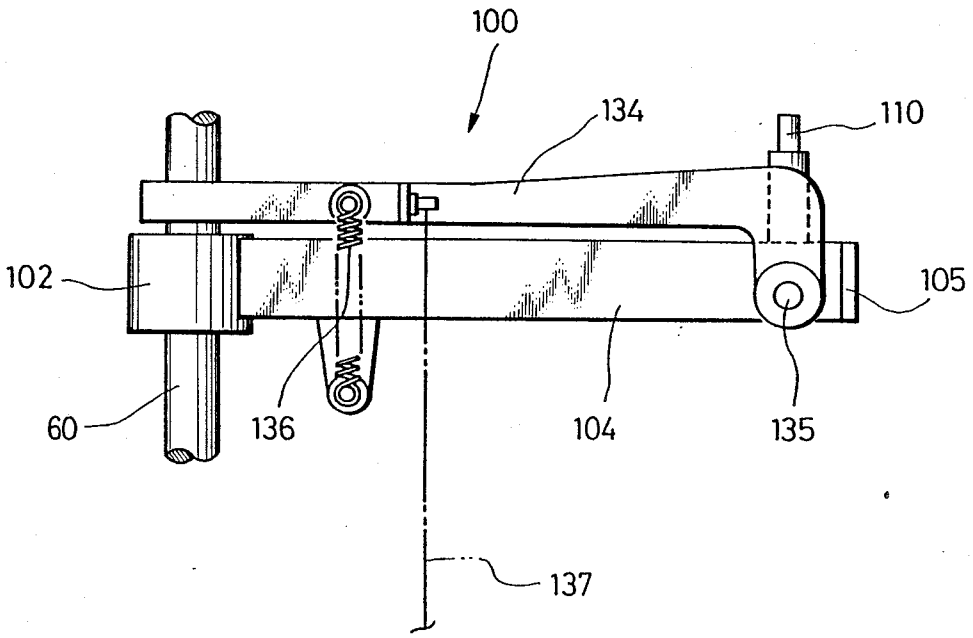

On the lever 107 a rocking lever 123 is supported rockably by a shaft 124, as shown in FIGS. 9 and 10, and an opening/closing pin 125 having a V-shaped wedge-like front end is fixed to the front end of the rocking lever 123. Further, at the front end portion of the lever 127, two opposed chucks 126 and 127 are rockably supported by shafts 128 and 129, respectively, and a tension spring 130 is mounted between the chucks 126 and 127 to urge both chucks in an opening direction. The opening/closing pin 125 is positioned between the base ends of the chucks 126 and 127 and is adapted to move vertically relative to both chucks thereby change the chuck spacing to open and close both chucks. On the arm 101 a rocking plate 131 is supported rockably by a shaft 138 and a pin 132 is fixed to one end of the rocking plate 131, the pin 132 being capable of abutting the rocking lever 123. The other end of the rocking plate 131 is urged upward by a compression spring 133 and is in abutment with a cam lever 134. The cam lever 134, as shown in FIG. 11, is supported at one end thereof by the foregoing support beam pivotably through a shaft 135 and is urged in the counterclockwise direction about the shaft 135 by means of a tension spring 136. And it is rockable about the shaft 135 through a vertically movable rod 137 connected to a cam mechanism (not shown but is the same as that shown in FIG. 8).

Under the above mechanism, the tensor 61 can be pulled out from the two-for-one twisting unit 2 by turning the arm 101 in the direction of the unit 2, holding the tensor 61 from a release portion 139 of the chucks 126 and 127, then raising and turning the arm 101 in the direction opposite to the unit. Holding or release for the tensor 61 by the chucks 126 and 127 is performed in the following manner. A vertical movement of the rod 137 is transmitted to the cam lever 134, rocking plate 131 and rocking lever 123 to move the opening/closing pin 125 up or down, thereby opening or closing the chucks 126 and 127.

The construction of the package changing device 200 will be described below in detail with reference to FIGS. 12 to 20.

Figure 12:
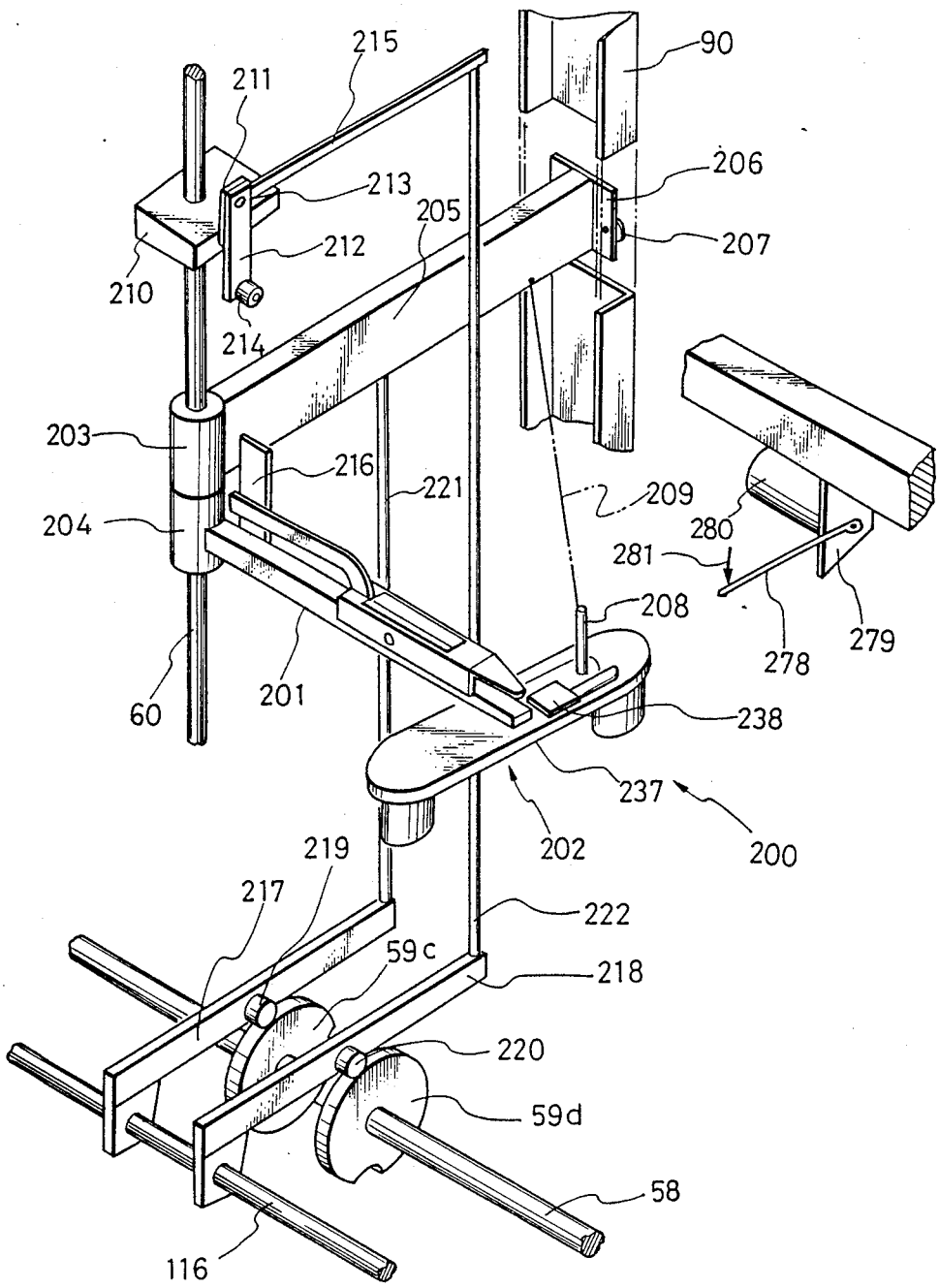
Figure 13:
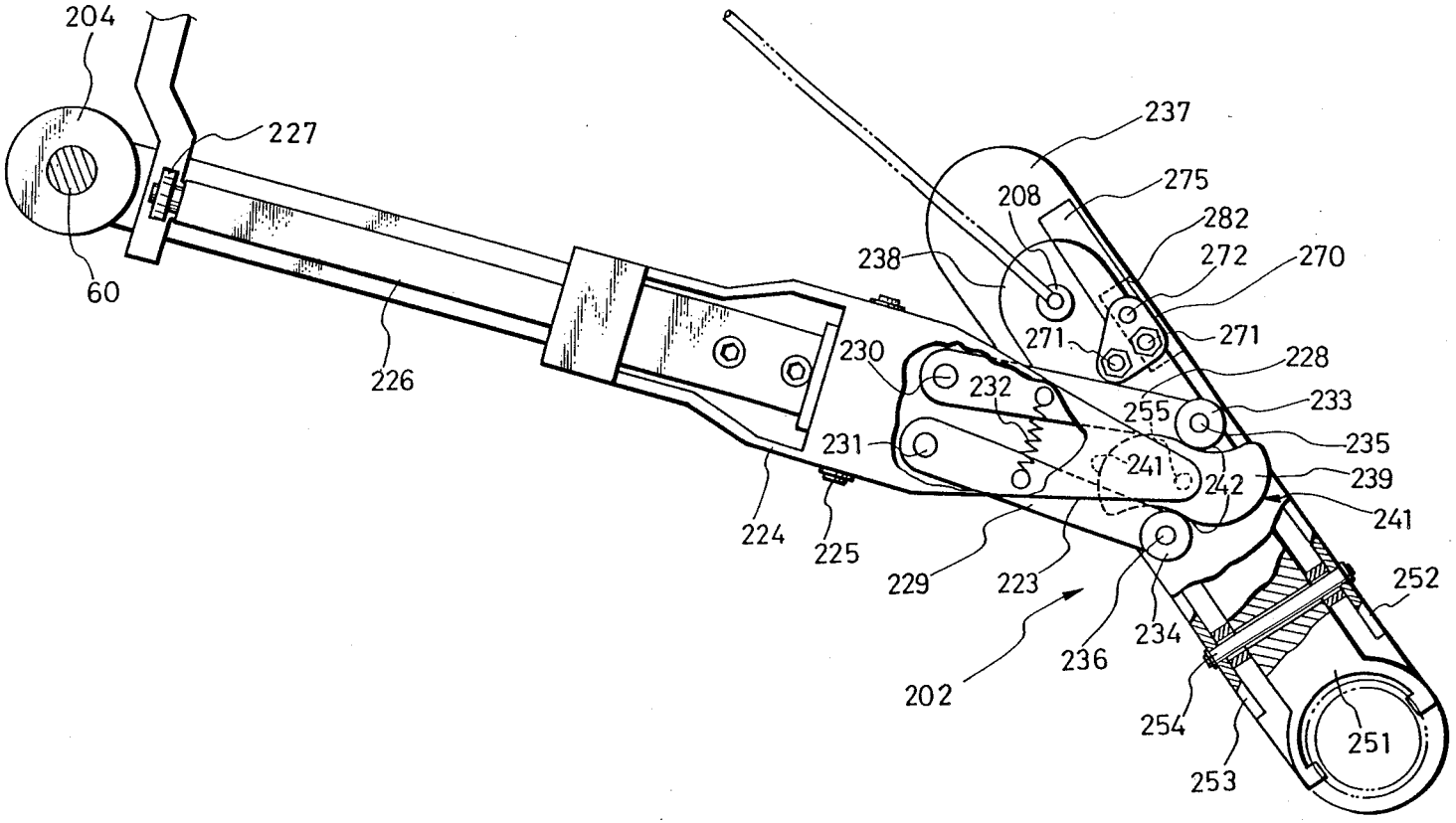
Figure 14:
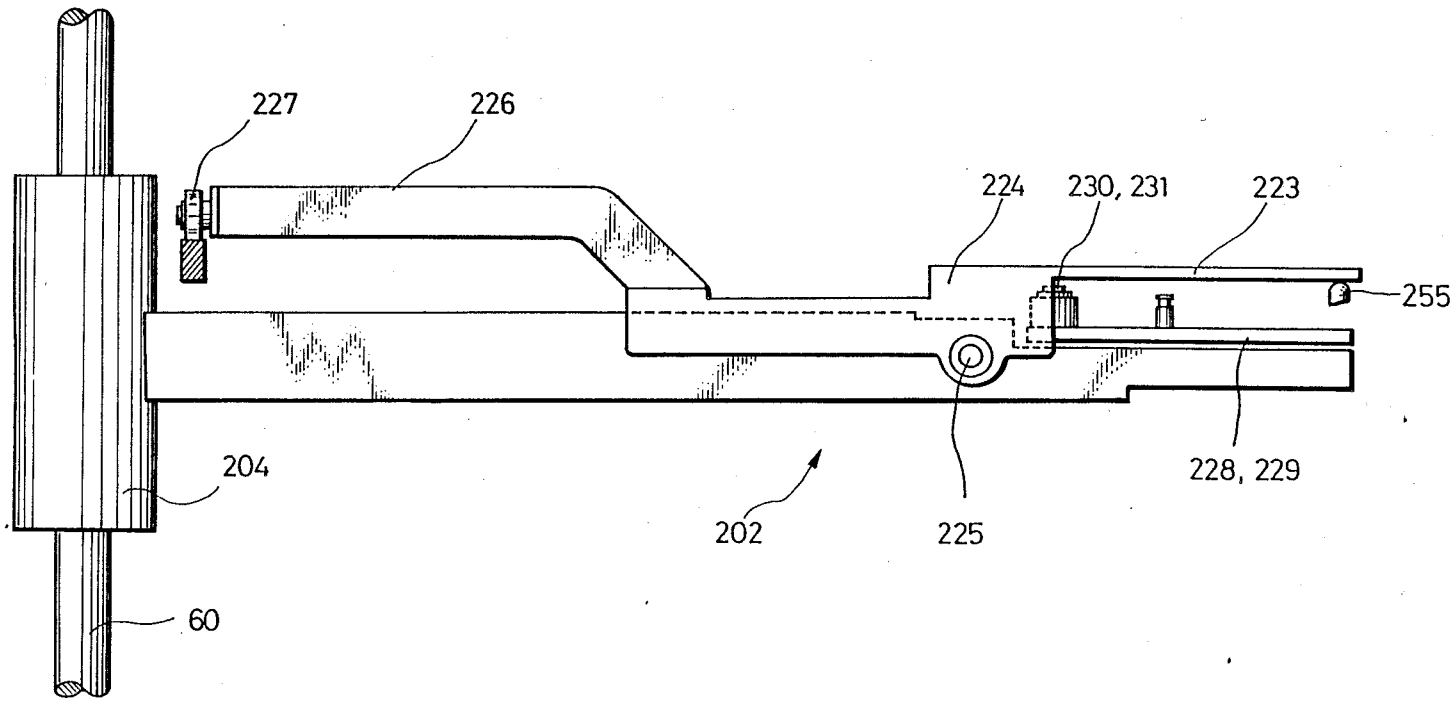

In FIG. 12, an upper cylindrical slider 203 and a lower cylindrical slider 204 are fitted on the main rod 60, the upper slider 203 being slidable vertically relative to the main rod 60 and the lower slider 204 also slidable vertically relative to the main rod 60 and rotatable. A support beam 205 is fixed to the upper slider 203, and to the other end of the support beam 205 is supported a guide roller 207 rotatably through a bracket 206, the guide roller 207 being movable along the inner surface of the generally ]-shaped guide pillar 90 which is a component of the automatic machine 26. To the lower slider 204 is fixed an arm 201 in a direction perpendicular to the support beam 205 in plan view. At the front end of the arm 201 an exchange hand 202 is supported pivotably by a shaft, and a pin 208 is fixed onto the exchange hand 202. Further, both ends of a link arm 209 are pivotably supported by the pin 208 and the support beam 205 respectively. A stationary plate 210 is fitted on the main rod 60 in a position above the upper slider 203 and a depending lever 212 is supported by the stationary plate 210 pivotably through a bracket 211 and a shaft 213, with an abutting roller 214 being supported by a shaft at the lower end of the lever 212. To the depending lever 212 is fixed a lever 215 integrally. The abutting roller 214 is capable of abutting an abutting plate 216 fixed upright to the arm 201.

In lower positions of the machine frame, cam plates **59*c* and 59*d* are fitted on the cam shaft 58 which is rotated by the motor 57, and cam followers 219 and 220 are supported through shafts by levers 217 and 218, respectively, which levers are tiltable about the support shaft 116, the cam followers 219 and 220 being in abutment with the cam plates 59*c* and 59*d*, respectively. When the motor 57 is operated, the cam shaft 58 and the cam plates 59*c*, 59*d* rotate, thereby causing the levers 217 and 218 to move vertically about the support shaft 116 according to the shape of the cam plates 59*c* and 59*d*. The front end of one lever 217 is connected to the support beam 205 through a rod 221, while the front end of the other lever 218 is connected to the lever 215 through a rod 222. Consequently, with a vertical movement of the front end of the lever 217, the support beam 205 and hence the arm 201 move vertically, while vertical movements of the front end of the lever 218 cause the lever 215 and the depending lever 212 to rock about the shaft 213, allowing the abutting roller 214 to push the abutting plate 216 to thereby permit pivoting of the arm 201 relative to the main rod 60**.

The construction of the exchange hand 202 will now be described with reference to FIG. 13 to 16. A rocking piece 224 of a ]-shaped section having an abutting piece 223 formed integrally at the front end thereof is mounted on the arm 201 through a shaft 225, and an engaging lever 226 is integrally fixed to the base end portion of the rocking piece 224. An abutting roller 227 is mounted to the base end portion of the engaging lever 226 through a shaft. At the front end portion of the arm 201 a pair of levers 228 and 229 are supported by shafts 230 and 231, respectively, the levers 228 and 229 being urged in directions approaching each other by means of a tension spring 232. Further, cam followers 233 and 234 are pivotably supported by shafts 235 and 236, respectively, at the front ends of the levers 228 and 229. At the front end of the arm 201, a restriction plate 238 and a cam plate 239 are supported by a shaft 240 successively from below. The base plate 237 and the cam plate 239 are fixed to the shaft 240, which shaft is rotatable relative to the arm 201, while the restriction plate 238 is loosely fitted on the shaft 240 pivotably. Onto the restriction plate 238 is fixed the pin 208. The cam followers 233 and 234 are in abutment with the peripheral surface of the cam plate 239. The cam plate 239 has a large-diameter portion 241 and a small-diameter portion 242. It assumes a stable state when the cam followers 233 and 234 are in abutment with the small-diameter portion, while when the large-diameter portion 241 and the cam followers 233, 234 are in abutment, the cam plate 239 becomes unstable and tries to rotate in a stable condition. At both ends of the lower surface of the base plate 237 there are provided chucks 243 and 244 of the following construction.

A rod 245 is fixed to the lower surface of the base plate 237 and a cap 246 is fitted on the front end of the rod 245. A deformable ring 247 formed of an elastic member such as rubber and a tubular slider 248 are loosely fitted on the rod 245 successively from below. The slider 248 is urged downward relative to the base plate 237 by means of a compression spring 249. A groove 250 is formed in the outer periphery of the slider 248 and a lever 251 is in engagement with the groove 250. The lever 251 is supported pivotably through a shaft 254 by support brackets 252 and 253 fixed to and depending from the base plate 237.

Figure 15:
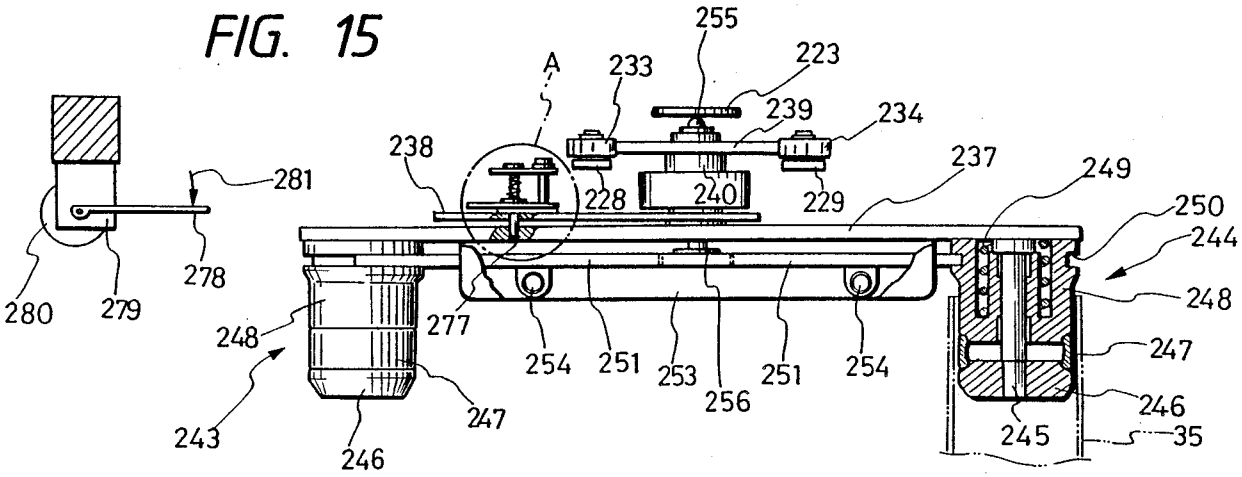
Figure 16:
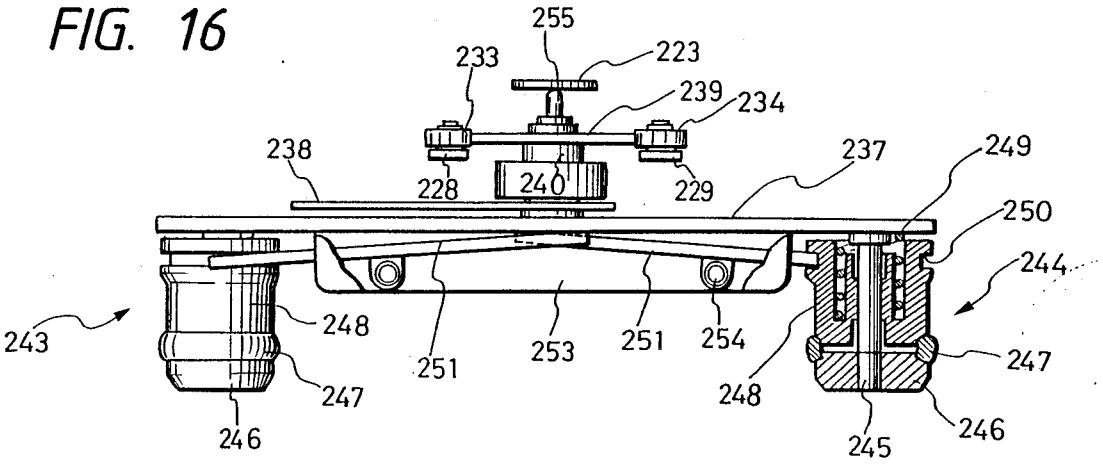

The shaft 240 is hollow and a slide pin 255 is inserted into the hollow portion, with an abutting plate 256 being fixed to the lower end of the pin 255, the abutting plate 256 being in abutment with the lever 251. Further, the upper end of the pin 255 is in abutment with the abutting piece 233. As shown in FIGS. 15 and 16, the slide pin 255 moves vertically with vertical movement of the abutting piece 233, allowing the chucks 243 and 244 to grip and release the guide pipe 35. More specifically, when the abutting piece 223 is in its lower position as in FIG. 15, the slide pin 255 is pushed downward by the abutting piece 223 and the lever 251 maintains a nearly horizontal state to lift the slider 248 up to the position of contact with the base plate 237 against the force of the spring 249. At this time, the deformable ring 247 does not undergo an external force so is not deformed and therefore it is impossible to hold the guide pipe 35. However, as shown in FIG. 16, as the abutting piece 223 moves to its upper position, the slide pin 255 rises by virtue of the spring 249, so that the lever 251 tilts, the slider 248 moves to its lower position and the deformable ring 247 is pressed vertically by both the cap 246 and the slider 248. Consequently, the deformable ring 247 is deformed radially outwards to hold the guide pipe 35 from the inside.

Figure 17:
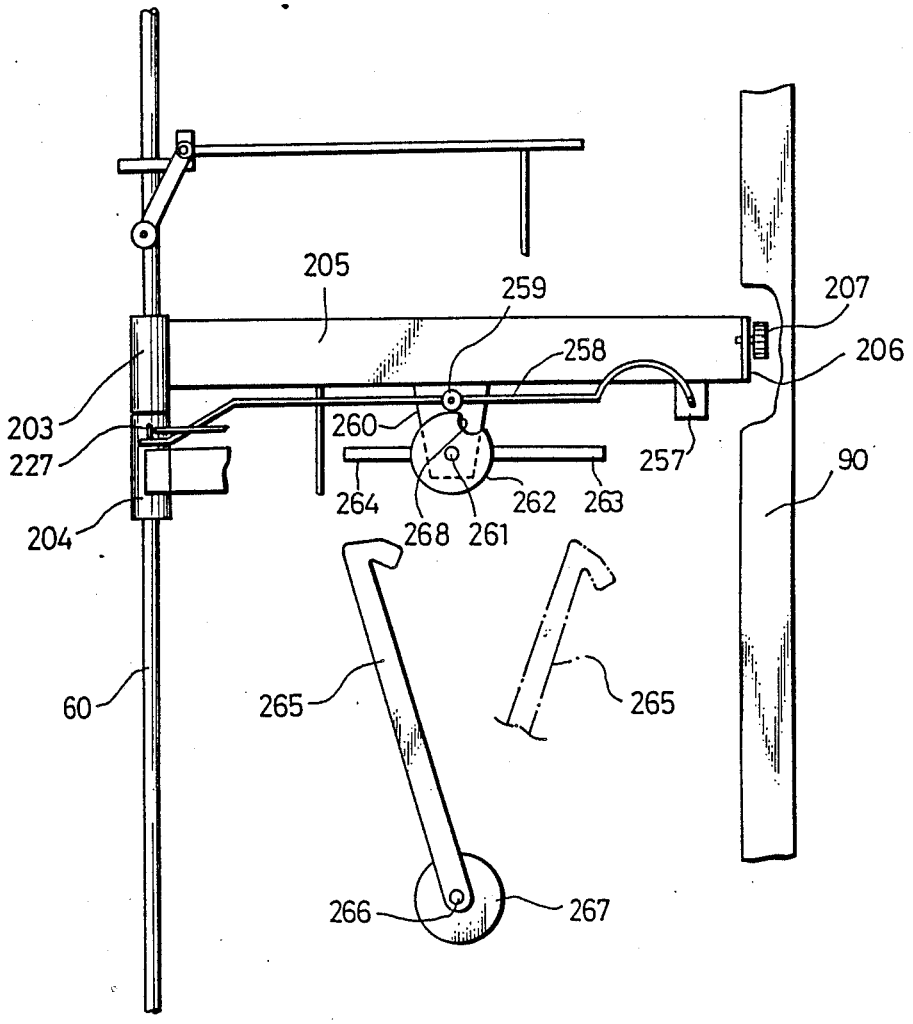

The mechanism for moving the abutting piece 223 vertically is shown in FIG. 17. One end of a rocking lever 258 is supported by the support beam 205 through a shaft and a bracket 257, the front end of the lever 258 being in abutment with the abutting roller 227. In an intermediate position of the rocking lever 258 there is mounted a cam follower 259 through a shaft, the cam follower 259 being in abutment with a cam plate 262 which is supported by the support beam 205 through a bracket 260 and a shaft 261. To the cam plate 262 are fixed levers 263 and 264 integrally. On the other hand, on the machine frame side, an abutting lever 265 is supported by a shaft 266. Under operation of a solenoid 267 the lever 265 takes two positions selectively which are a solid line position and a chain line position in FIG. 17. Therefore, as the support beam 205 goes down with the abutting lever 265 held in its chain line position, the abutting lever 265 comes into abutment with the lever 263, causing the cam plate 262 to turn in the counterclockwise direction, so that the cam follower 259 enters a recess 268 of the cam plate 262 to bring down the rocking lever 258. With descent of the rocking lever 258, the abutting roller 227 does down, while the abutting piece 223 goes up. With the abutting lever 265 in its solid line position, the abutting piece 223 goes down under operations reverse to the above.

Figure 18:
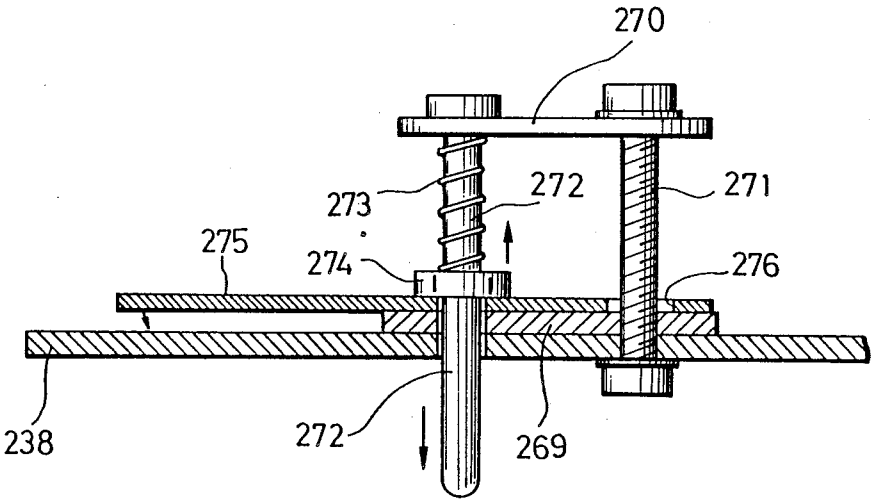

In the restriction plate 238, as shown in FIG. 18, a space piece 269 is fixed to the upper surface of the plate 238. In an upper position, moreover, a stationary plate 270 is fixed to the plate 238 through a bolt 271, with a pin 272 depending slidably from the stationary plate 270. A spring 273 is fitted on the pin 272 and an abutting nut 274 is fixed onto the same pin, the pin 272 extending through a hole formed in the space piece 269. A movable plate 275 is mounted between the nut 274 and the space piece 269. The pin 272 extends also through the movable plate 275, which plate 275 is also formed with a hole 276 large enough to permit the bolt 271 to extend therethrough. The base plate 237 has a hole 277 which permits insertion therein of the pin 272 (see FIG. 15). When the pin 272 is inserted into the hole 277, the restriction plate 238 and the base plate 237 move integrally. A lever 278 for disengaging the pin 272 from the base plate 237 is shown in FIG. 12. The lever 278 is supported by the machine frame pivotably through a shaft and a bracket 279 and it can move in both an arrow direction 281 and a direction opposite to the arrow upon operation of a solenoid 280. When the lever 278 is moved in the arrow direction 281 to push the movable plate 275 downwards, the but 274 rises against the force of the spring 273 and the whole of the pin 272 moves upwards, so that the pin 272 and the base plate 237 are disengaged from each other. Again, upon engagement of the pin 272 with the base plate 237, the pin 272 moves along a slope 282 formed on the upper surface of the base plate 237 until it enters the hole 277, whereupon the base plate 237 and the restriction plate 238 become integral with each other through the pin 272.

Figure 19:
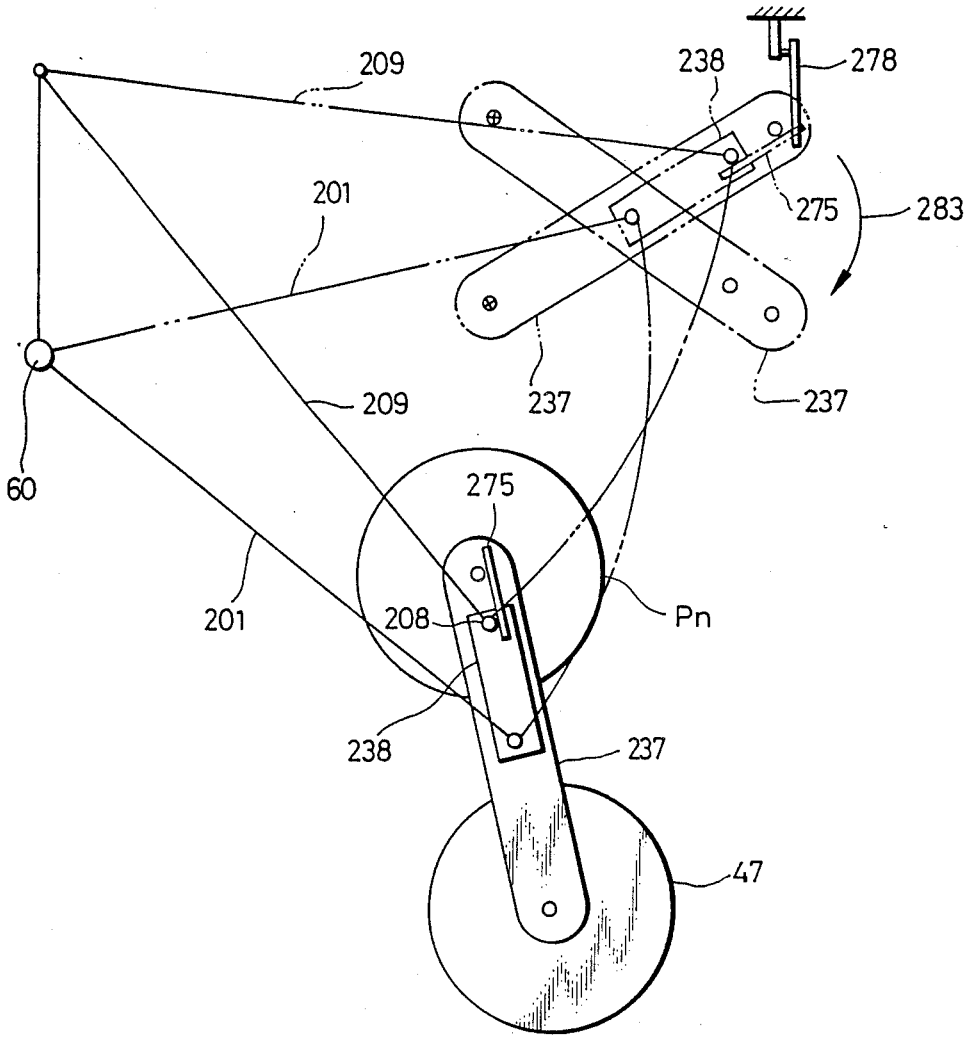
Figure 20:
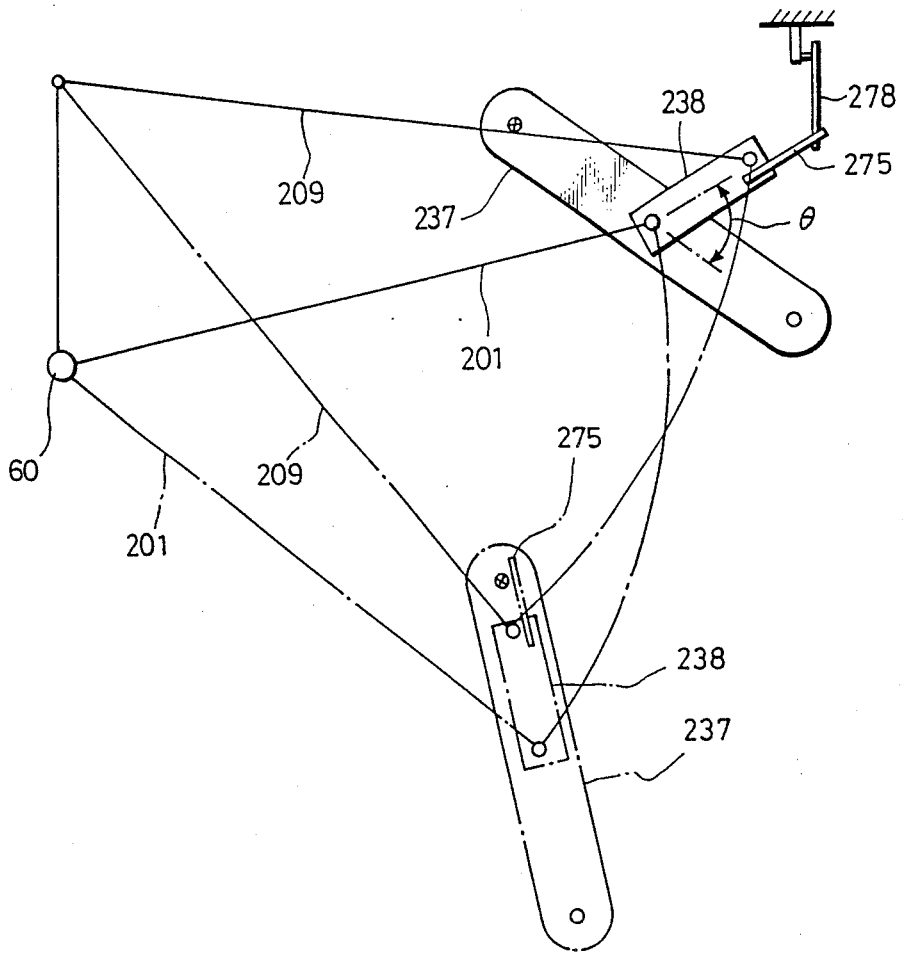

Under the above construction, the package changing device 200 operates as shown in FIGS. 19 and 20. With the base plate 237 and the restriction plate 238 integral with each other, the package changing device 200 advances to the two-for-one twisting unit 2 from the automatic machine 26 under movement of the link mechanism of arm 201, restriction plate 238 and link arm 209. In FIG. 19, the mark Pn represents a new feed package on the tray and numeral 47 denotes a balloon cover of the unit 2. The movement of the arm 201 stops in its solid line position in FIG. 19 and the new feed package and the guide pipe are held by the chucks 243 and 244, respectively. At this time, the cam followers 233 and 234 are in abutment with the small-diameter portion 242 of the cam plate 239.

After completion of the holding by the chucks 243 and 244, the arm 201 is turned counterclockwise up to its dash-double dot line position in FIG. 19. At this time, the cam followers 233 and 234 are in abutment with the large-diameter portion 241 of the cam plate 239. Then, the lever 278 is operated to disengage the base plate 237 and the restriction plate 238 from each other. The restriction plate 238 does not change in position with the link arm 209, but as the cam plate 239 rotates, the base plate 237 turns in the direction of an arrow 283 and moves to its dot-dash line position. The can plate 239 rotates for shifting its position of abutment with the cam followers 233 and 234 from the unstable large-diameter portion 241 to the stable small-diameter portion 242, as previously noted. This condition is as indicated by solid lines in FIG. 20.

Then, the arm 201 is turned up to its dot-dash line position in FIG. 20. As the turning motion of the arm 201 advances, the restriction plate 238 tries to strike on the base 237. More particularly, the restriction plate 238 is moved by the foregoing link mechanism, while the base plate 237 moves while maintaining the abutment of the small-diameter portion 242 of the cam plate 239 with the cam followers 233 and 234, so its movement is under decrease of the angle $\theta$ between the restriction plate 238 and the base plate 237. When the pin 272 strikes on and comes into engagement with the base plate 237 from the slope 282 formed on the upper surface of the base plate 237, both plates 237 and 238 become integral in their movement.

As a result of the above movements, the new feed package and the guide pipe, held by the base plate 237 which has moved up to its dot-dash line position in FIG. 20 are changed in position with each other. Upon release of the chucks 233 and 234 in this position, the new feed package is supplied to the two-for-one twisting unit 2 and an unloaded guide pipe is loaded onto the tray. According to the package changing device 200, the new feed package and the guide pipe (empty feed package) are exchanged at a time. Further, the base plate 237 is turned 180° by utilizing the link mechanism and the cam plate 239 and also utilizing the movement of the arm 201. Moreover, the operation and release of the chucks 243 and 244 are performed by utilizing vertical moments of the arms 201.

Figure 22:
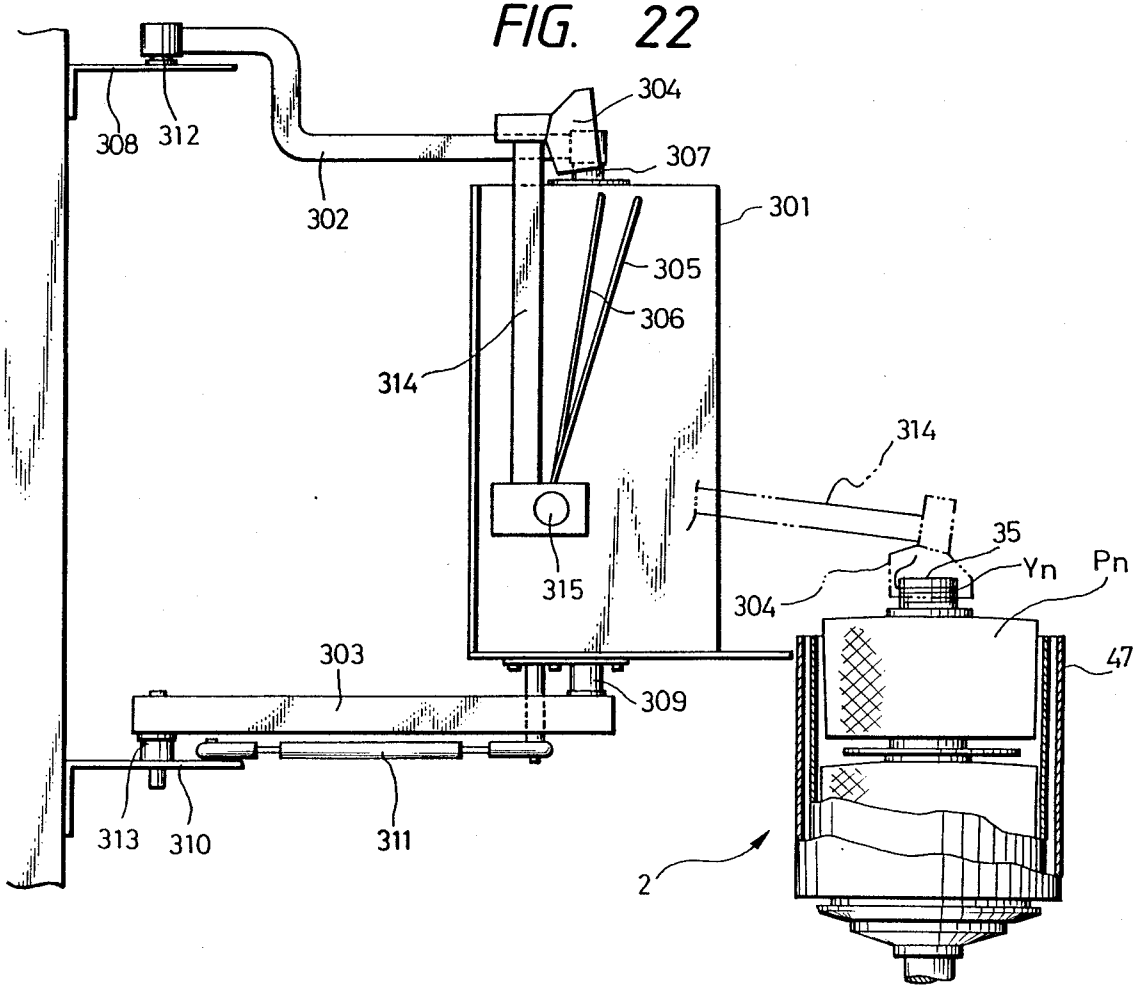
Figure 23:
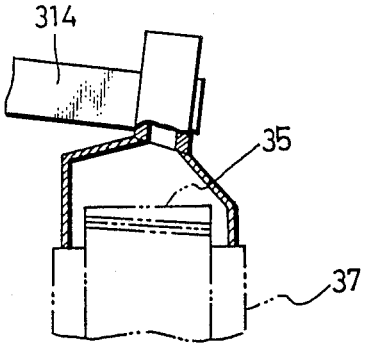

The construction of the yarn end finding device 300 will be described below in detail with reference to FIGS. 21 to 23.

Figure 21:
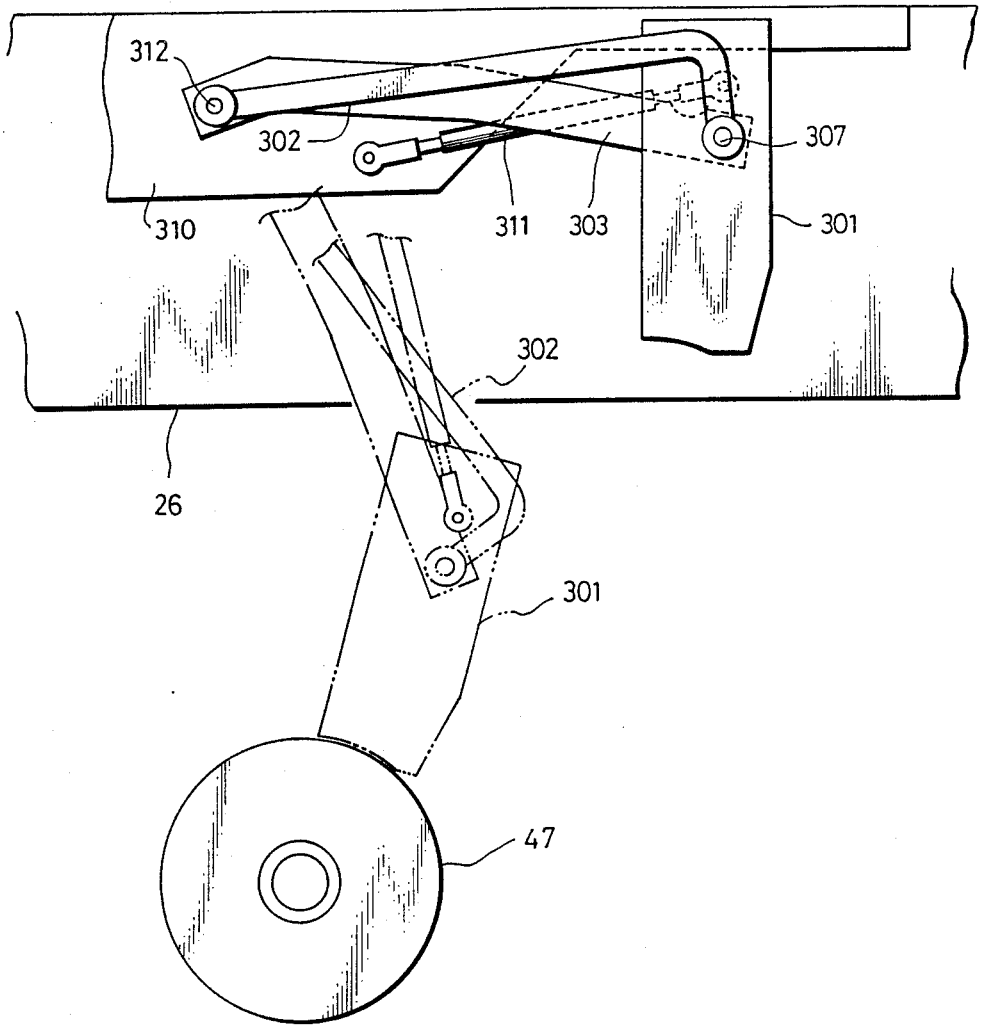

In FIG. 21, one end of an upper arm 302 is mounted through a shaft 307 to the upper surface of a box 301 which is generally in the shape of a rectangular parallelopiped, while the other end of the upper arm 302 is mounted through a shaft 312 to a bracket 308 which is fixed to the machine frame. Further, one end of a lower arm 303 is mounted through a shaft 309 to the lower surface of the box 301, while the other end of the lower arm 303 is mounted through a shaft 313 to a bracket 310. Numeral 311 denotes a link arm which is mounted at one end to the box 301 through a shaft and at the other end to the bracket 310 also through a shaft.

The lower arm 303 is turned about the shaft 313 by a mechanism (not shown, since this mechanism is the same as the turning mechanism for the arm 101 in the tenser moving device 100, detailed explanation will be omitted); as a result, the box 301 is moved toward the two-for-one twisting unit 2 by the link mechanism of lower arm 303, box 301 and link arm 311. In FIG. 21 there is shown a balloon cover 47 of the unit 2.

A connecting rod 314 and yarn conveying levers 305 and 306 are mounted to a side face of the box 301 through a shaft 315, and a yarn end finding mouth 304 is fixed to the front end of the connecting rod 314. The connecting rod 314 and the yarn conveying levers 305, 306 can be tilted about the shaft 315 separately by a gear mechanism provided within the box 301. The yarn end finding mouth 304 is funnel-shaped, through which suction and blowoff of air can be done by changeover in the box 301.

After the new feed package Pn has been loaded to the unit 2, the box 301 is moved to a position close to the package Pn, the connecting rod 314 is tilted and the yarn end Yn wound on the upper portion of the guide pipe 35 is sucked by the mouth 304. Thereafter, the connecting rod is brought into its upright position and the tensor 61 is loaded to the guide pipe 35, then the connecting rod 314 is again tilted and this time a current of air is blown off from the mouth 304 to introduce the yarn end into the spindle. Subsequently, there is performed a yarn passing operation on the unit 2 side and the yarn end drawn out from the inner surface of the balloon cover 47 is conveyed upwards by the yarn conveying levers 305 and 306.

Figure 24:
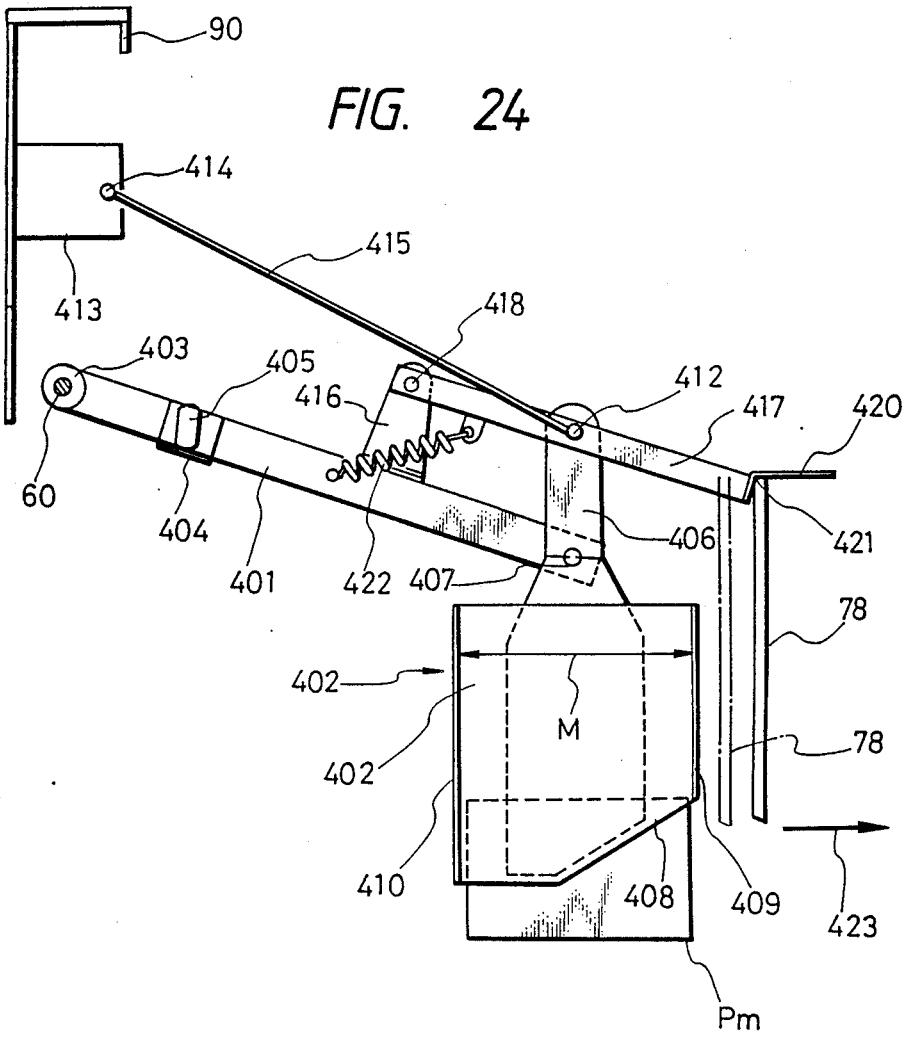
Figure 25:
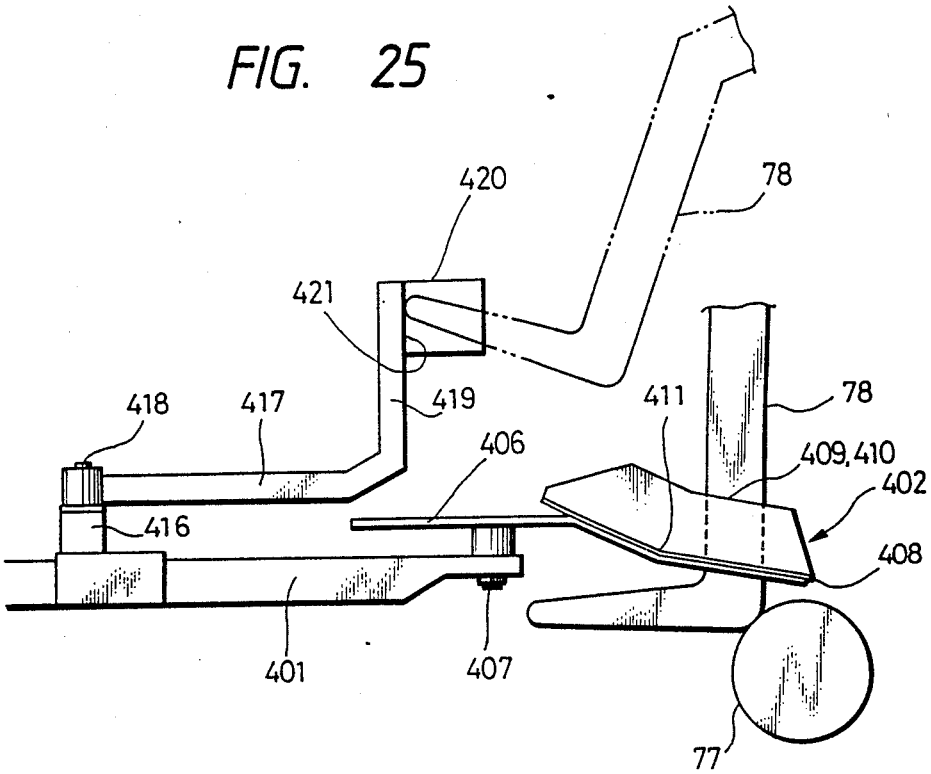

The construction of the full-wound package transfer device 400 will be described below in detail with reference to FIGS. 24 to 26.

Figure 26:
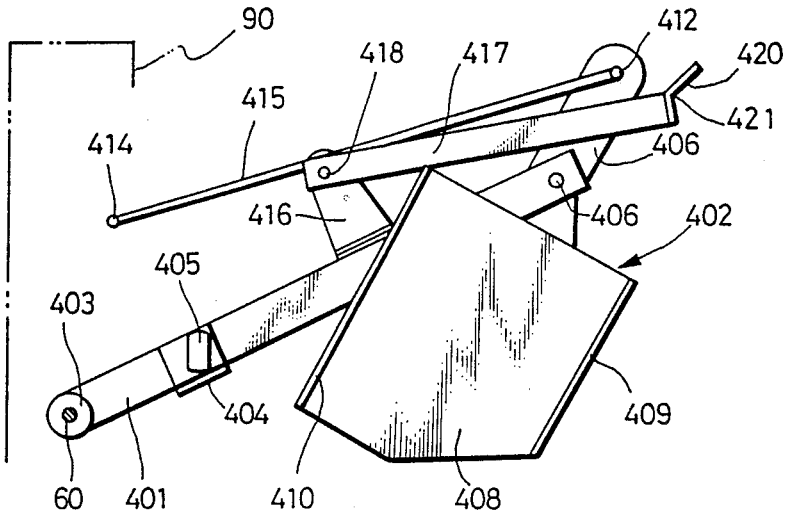

In FIG. 26, a cylindrical slider 403 is fitted on the main rod 60 so as to be pivotable relative to the latter. An arm 401 is fixed to the slider 403 and an abutting plate 404 is suspended from the arm 401, with an abutting roller 405 being attached thereto, the abutting roller 405 being movable by the same mechanism as that for the abutting roller 214 of the package changing device 200. To the front end of the arm 401 is mounted a support member 406 through a shaft 407, with a guide plate 402 being fixed to the support member 406. The guide plate 402 comprises a plate 408 of width M at least corresponding to the take-up package width and bent guide portions 409 and 410 which are bent vertically on both sides of the plate 408. The plate 408 is somewhat bent at a middle position 411. A pin 412 is mounted upright at the other end portion of the support member 406 and a link arm 415 is mounted between the pin 412 and a pin 414 erected on a bracket 413 which is fixed to the guide pillar 90.

A bracket 416 is fixed to the arm 401 is an approximately intermediate position and an L-shaped rod 417 is mounted to the bracket 416 through a shaft 418. The L-shaped rod 417 has a rising portion 419, with a push-out plate 420 being fixed to the front end of the rising portion 419. The push-out plate 420 has a <shaped bent portion 421. A tension spring 422 is mounted between the L-shaped rod 417 and the arm 401.

Under the above construction, for the delivery of a full-wound take-up package onto the conveyor 80, the arm 401 is turned clockwise about the main rod 60. Under the action of the link mechanism of arm 401, support member 406 and link arm 415, the guide plate 402 approaches the take-up package while taking a position orthogonal to the package. During this movement, the cradle arm 78 comes into abutment with the push-out plate 420. With further movement of the arm 401, the cradle arm 78 undergoes a force from the push-out plate 420 which force acts to expand the arm in the direction of an arrow 423. As the cradle arm 78 is moved in that direction by the said force, the full-wound package Pm which has been held by the arm 78 is disengaged from the same arm and drops. In the dropped position of the package Pm there is located the guide plate 402 and the package Pm rolls toward the conveyor 80 with tilting of the guide plate.

The construction of the yarn end transferring device 500 will be described below in detail with reference to FIGS. 27 to 30.

Figure 27:
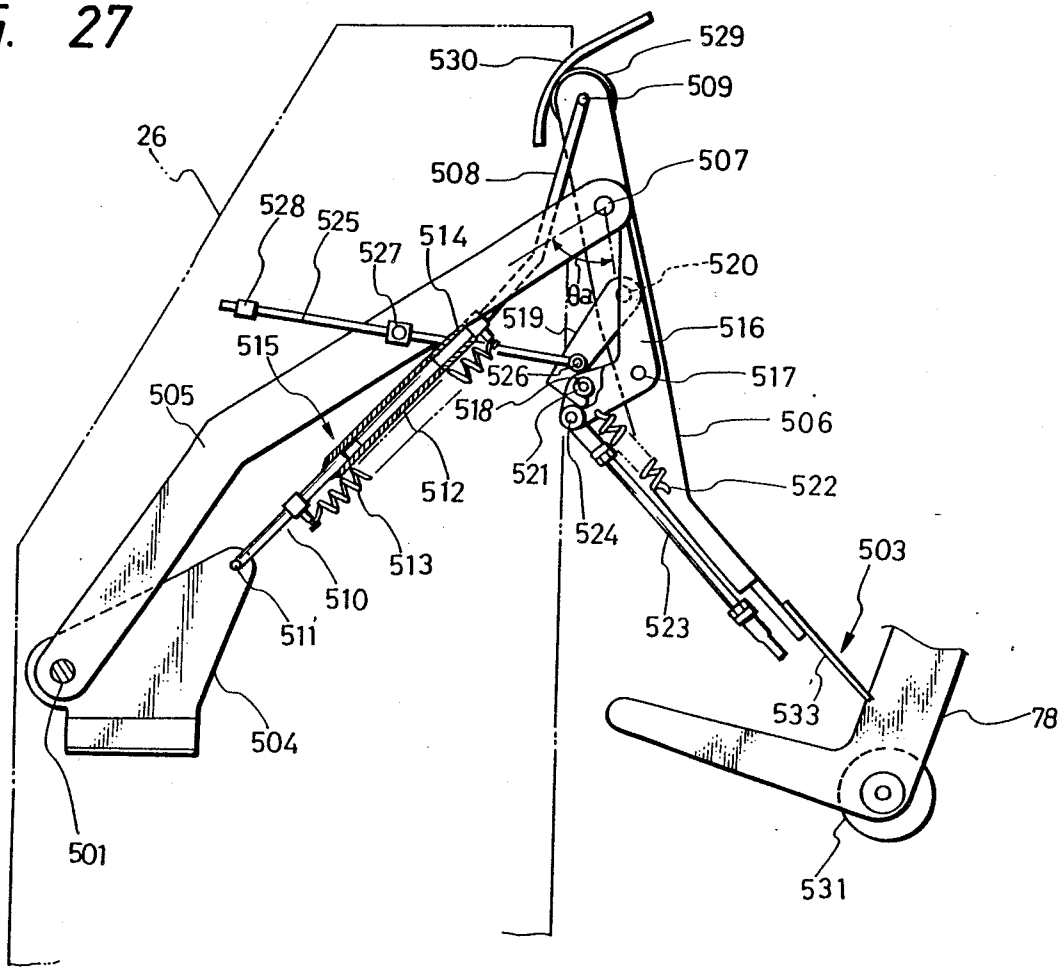

In FIG. 27, a rod 501 is rotatably supported by a bracket 504 fixed to the machine frame and the base end portion of a first arm 505 is fixed to the rod 501. To the front end of the first ar 505 is mounted a second arm 506 rotatably through a shaft 507 and a yarn holding member 503 is mounted at the front end portion of the second arm 506. To the base end portion of the second arm 506 is mounted one end of a slide rod 508 through a shaft 509, while to the bracket 504 is mounted a guide-side rod 510 through a shaft 511, and to the rod 510 is fixed a tubular guide rod 512 integrally. The slide rod 508 is inserted slidably into the guide rod 512 and a tension spring 513 is mounted between the guide-side rod 510 and the slide rod 508 to urge the two in directions approaching each other. Numeral 514 denotes a collar fitted on the slide rod 508. The guide-side rod 510 and the slide rod 508 are generically called a link rod 515.

In an intermediate position of the second arm 506 there is mounted an L-shaped lever 516 rotatably through a shaft 517 and also in a like position there is mounted an engaging lever 519 rotatably through a shaft 520 which lever has a hook portion 518 at the front end thereof. An engaging roller 521 is supported by the L-shaped lever 516 through a shaft and the lever 516 is urged counterclockwise about the shaft 517 by means of a spring 522 mounted between the lever 516 and the second arm 506. Further, one end of a connecting rod 523 is mounted to the L-shaped lever 516 through a shaft 524. To the engaging lever 519 is mounted one end of the restriction rod 525 through a shaft 526, which rod 525 is slidable through a slide guide 527 fixed to the first arm 505, with a stopper 528 being fixed to the other end of the rod 525.

To the base end portion of the second arm 506 is mounted a guide roller 529 pivotably through a shaft, the guide roller 529 being movable through a guide plate 530 fixed to the machine frame.

Under the above construction, the first arm 505 is turned clockwise relative to the shaft 501 from its state shown in FIG. 27, by a mechanism (not shown) (this mechanism utilizes the motor 57, cam shaft 58 and the movement of the cam plate 59 like the moving mechanisms such as that in the package changing device 200 already described in detail, so its details will be omitted). Under the action of the link mechanism of the first arm 505, second arm 506 and link rod 515, the yarn holding member 503 at the front end of the second arm 506 moves to evade a new take-up tube 531 mounted on the cradle arm 78. In brief, the first arm 505 turns while the base end position of the second arm 506 is restricted by the link rod 515.

With further turning motion of the first arm 505, the components are moved by the link mechanism in a contracted condition of the link rod 515. At this time, the angle $\theta a$ between the first arm 505 and the second arm 506 increases gradually and the restriction rod 525 slides in a direction in which the stopper 528 approaches the slide guide 527.

Upon abutment of the stopper 528 with the slide guide 527, as shown in FIG. 27, the first arm 505 pivots in a restricted condition of the angle $\theta a$ between the two arms 505 and 506, so the link rod 515 assumes an extended state. With further pivoting of the first arm 505, the engaging lever 519 turns clockwise about the shaft 520, so that its hook portion 518 and the engaging roller 521 are disengaged from each other and consequently the L-shaped lever 516 turns counterclockwise about the shaft 517 under the biasing force of the spring 522 to push out the connecting rod 523 in the direction, indicated at 532, of the yarn holding member 503.

With the movement of the connecting rod 523, the yarn end which has been conveyed to below the feed roller 75 by the yarn conveying levers 305 and 306 is held by the yarn holding member 503. Thereafter, operations reverse to the above are performed, so that the yarn end transferring device moves from its state shown in FIG. 28 to its state shown in FIG. 28 and the guide roller 529 moves along the guide plate 530. Consequently, the second arm 506 moves in a direction to reduce the angle $\theta a$, resulting in that the first and second arms 505 and 506 assume a compactly folded state.

Figure 29:
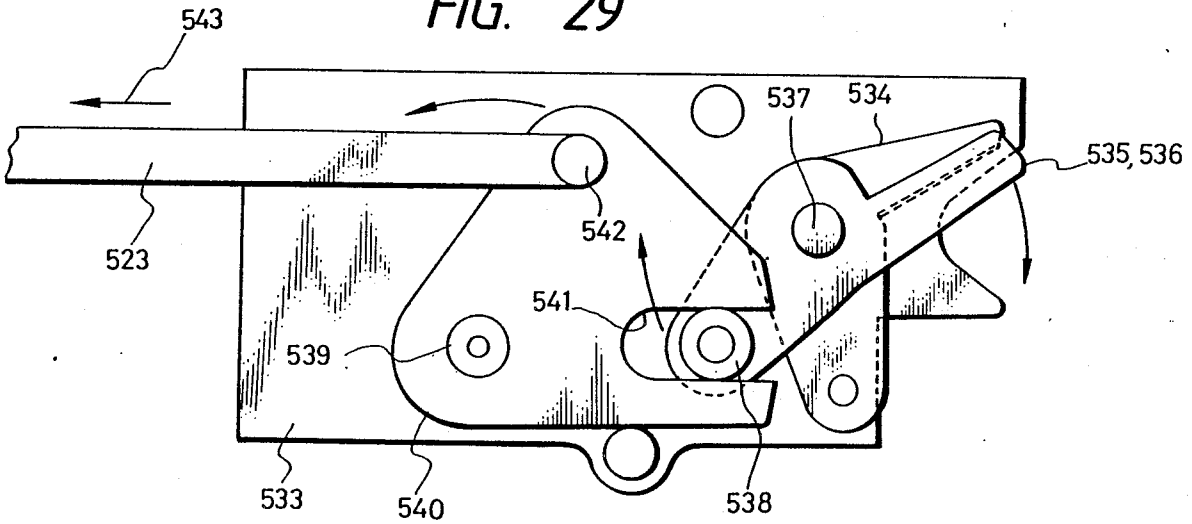
Figure 30:
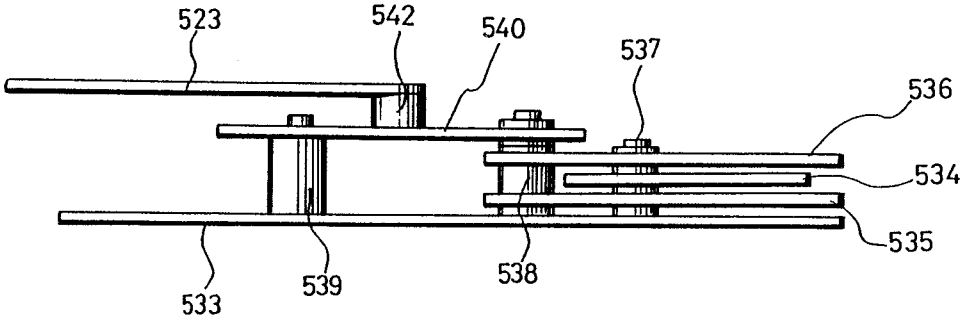

The construction of the yarn holding member 503 will now be explained. A base plate 533 is fixed to the front end of the second arm 506 and a stationary blade 534 is fixed to the front end portion of the base plate 533. Further, a movable blade 535 and a holding blade 536 are supported pivotably about a shaft 537 in vertically sandwiching positions for the stationary blade 534. The movable blade 535 and the holding blade 536 are interconnected through a shaft 538, the shaft 538 being in engagement with a slot 541 of a lever 540 which is supported by the base plate 533 pivotably through a shaft 539. To one end of the lever 540 is mounted one end of the connecting rod 523 through a shaft 542. In FIG. 29 the yarn end is in a held condition, but when the connecting rod 523 moves in the direction opposite to an arrow 543, as mentioned above, the lever 540 turns clockwise about the shaft 539, so that the movable blade 535 and the holding blade 536 move counterclockwise integrally about the shaft 537 to cut the yarn between the stationary blade 534 and the movable blade 535, and the yarn is held by the stationary blade 534 and the holding blade 536. The yarn thus held is released in the following manner. The connecting rod 523 is moved in the direction of the arrow 543, so that the associated components move reversely to the above to form an opening between the stationary blade 534 and the holding blade 536, whereby the yarn is released.

Figure 28:
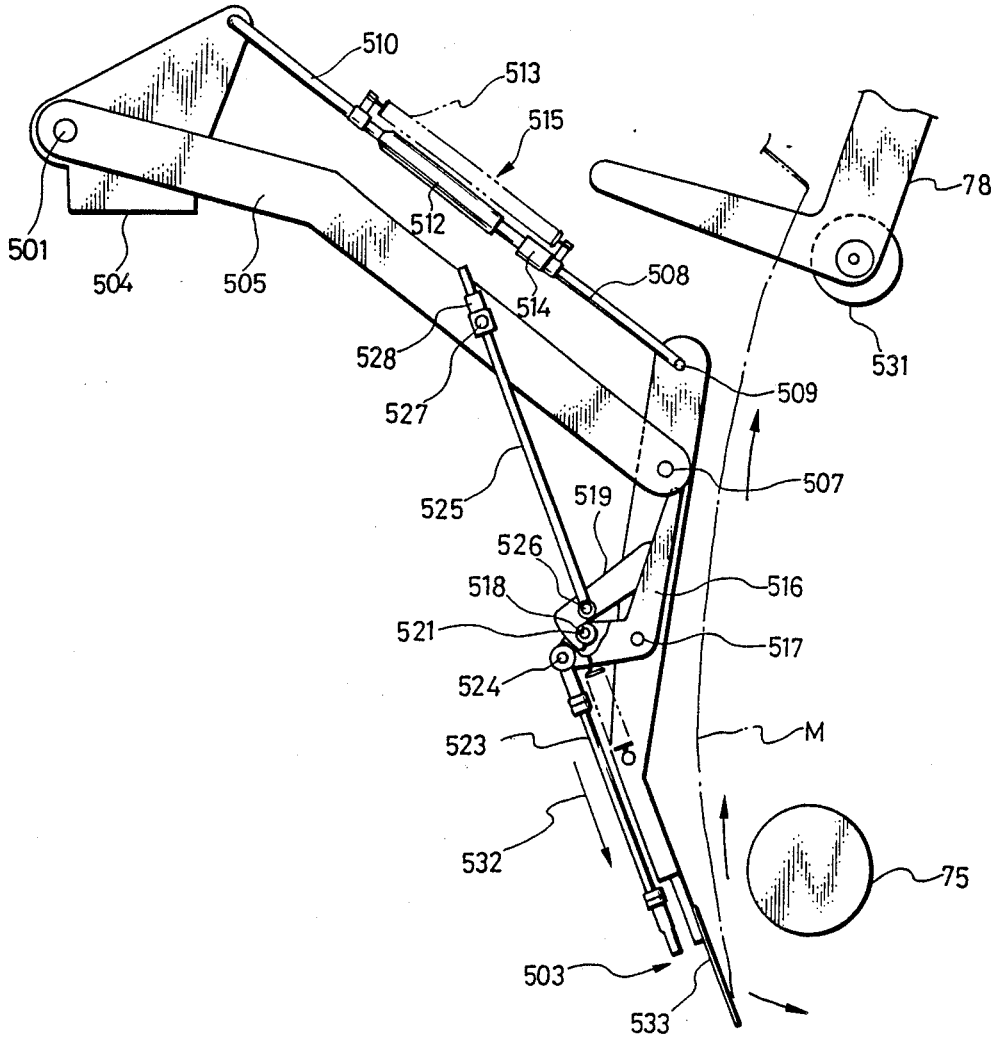

The path of movement of the front end portion of the yarn holding member 503 is indicated at M in FIG. 28. As shown in the same figure, the front end portion of the yarn holding member 503 moves so as to evade the take-up tube 531 and the feed roller 75 and to be positioned below and above the feed roller 75 and the take-up tube 531, respectively.

The construction of the empty take-up tube feeder 600 will be described below in detail with reference to FIG. 31.

Figure 31:
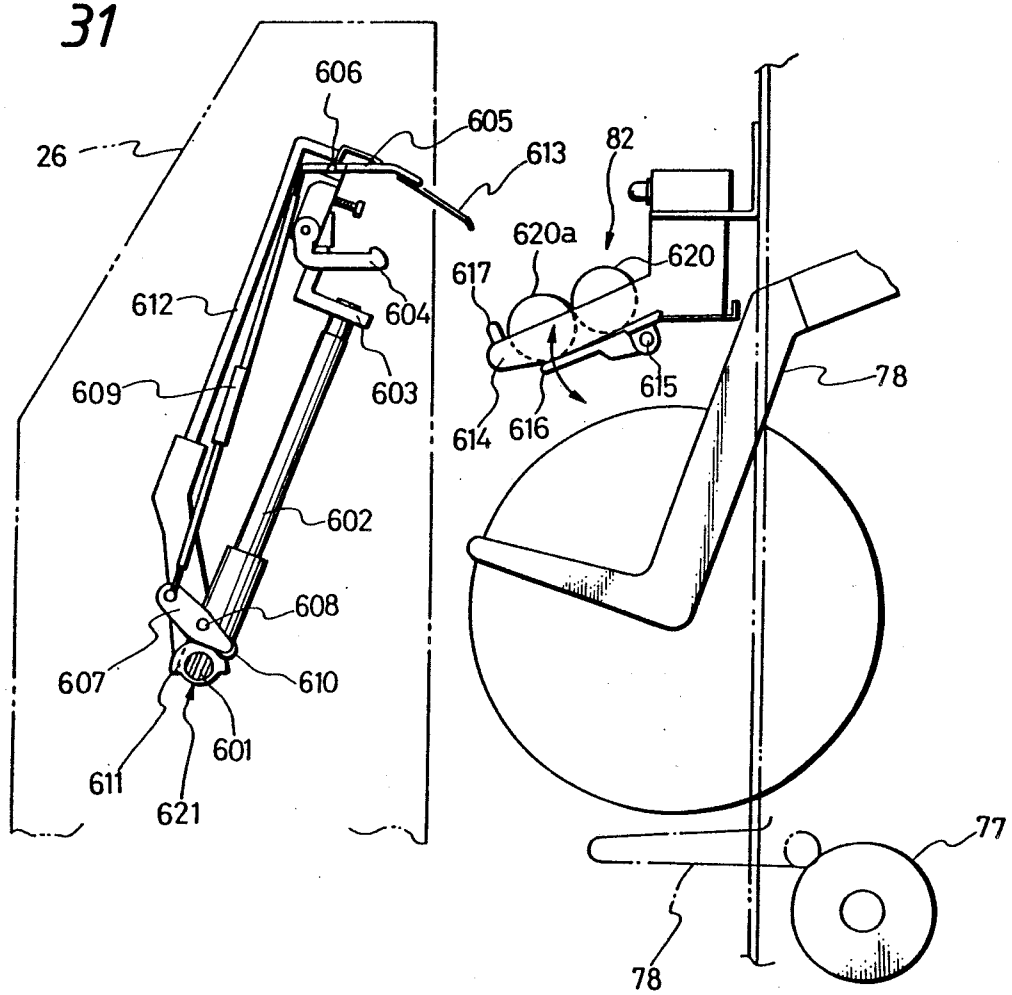
FIG. 31 is a front view showing how empty take-up tubes are fed.

In FIG. 31, an arm 602 is pivotably supported by a shaft 601 fixed to the machine frame. To the front end of the arm 602 is fixed a bracket 603, to which bracket is fixed a stationary pawl 604, and a movable pawl 605 is pivotably supported by a shaft 606. To the base end portion of the arm 602 is mounted a lever 607 pivotably through a shaft 608 and a link rod 609 is connected to both one end of the lever 607 and the movable pawl 605. To the other end of the lever 607 is mounted a cam follower 610 through a shaft, the cam follower 610 being in abutment with the peripheral surface of a cam plate 611 fixed to the shaft 601. A rear arm 612 is pivotably supported by the shaft 601 and a plate 613 is fixed to the front end of the rear arm 612.

On the two-for-one twisting unit 2 side there is installed the stocker 82, which comprises side plates 614, a bottom plate 616 pivotable about a shaft 615, and a stopper 617, the bottom plate 616 being urged clockwise by means of a spring (not shown) at all times.

In supplying a new take-up tube 620 to the cradle arm 78, the arm 602 is tilted about the shaft 601 by a mechanism (not shown). When both pawls 604 and 605 have arrived at the position of the head take-up tube **620*a*, the cam follower 610 enters a cam groove 621 of the cam plate 611 so the lever 607 turns clockwise about the shaft 608 to push the link rod 609 forwards. With the movement of the link rod 609, the movable pawl 605 turns clockwise about the shaft 606 and the head paper spool 620*a* is held by the stationary pawl 604 and the movable pawl 605. At this time, the second and the following paper spools 620 are prevented from moving forward by the plate 613**.

The arm 602 is further turned. The bottom plate 616 turns counterclockwise. When the take-up tube **620*a* held by both pawls 604 and 605 has turned up to between cradle arms 78, the cam follower 610 strikes on the large-diameter portion of the cam plate 611 to release the paper spool 620a** again.

The construction of the cradle arm moving device 700 will be described below in detail with reference to FIGS. 32 and 33.

Figure 32:
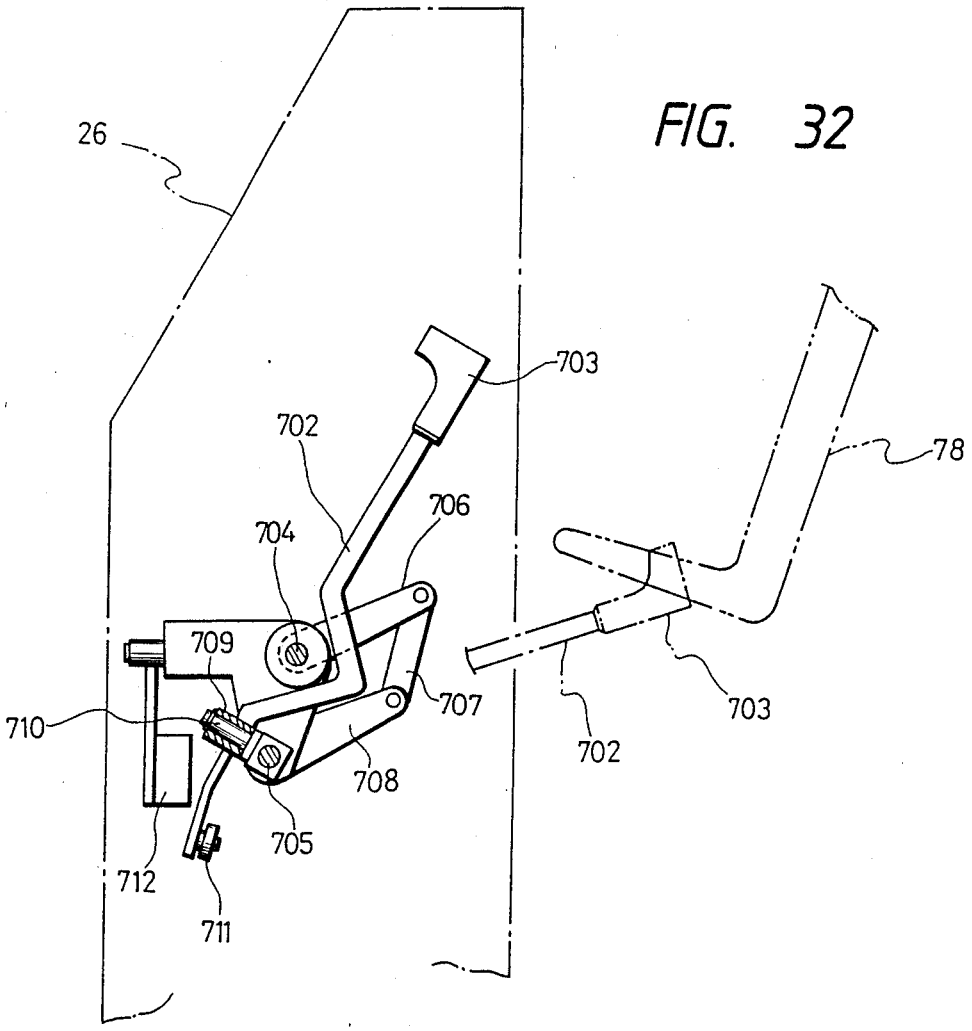
Figure 33:
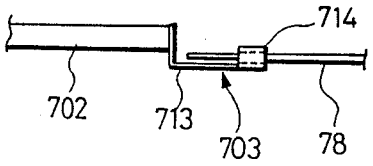

In FIG. 32, a rotative driving shaft 704 and a driven shaft 705 are interconnected through link levers 706, 707 and 708, whereby the rotation of the driving shaft 704 is transmitted to the driven shaft 705. A bracket 709 is mounted on the driven shaft 705 pivotably about a shaft 710. Further, an arm 702 is secured to the bracket 709 and a cradle arm opening member 703 is secured to the front end of the arm 702, while to the base end of the arm 702 is mounted an abutting roller 711 through a shaft. Numeral 712 denotes an abutting plate capable of coming into abutment with the abutting roller 711. The abutting plate 712 is moved to push the abutting roller 711 by a mechanism (not shown). The cradle arm opening member 703, as shown in FIG. 33, is integrally provided with a cradle arm holding portion 714 formed by bending an L-shaped plate 713 in ]-shape.

The driven shaft 705 is rotated by rotating the driving shaft 704 to let the arm tilt in the clockwise direction about the driven shaft 705, thus causing the cradle arm 78 to enter the ]-shape of the holding portion 714. Then, the abutting plate 712 is turned to cause the abutting roller 711 and hence the arm 702 to turn about the shaft 710, thereby moving the cradle arm 78 to move to this side in the drawing to effect unloading of the take-up tube.

In addition to the devices described above, the automatic machine 26 may be further provided with a joining device for joining cut ends of yarn.

According to an embodiment of the present invention, as is apparent from the above description, all the operations of discharging a full-wound take-up package, supplying an empty take-up tube, subsequent taking out of the take-up tube of a feed package which has become unloaded, and supplying a new feed package, can be performed automatically without relying on manual labor. Besides, the change of take-up package and that of feed package can be done at a time. Consequently, it is made possible to attain reduction of the working labor and shortening of the working time.

What is claimed is:

1. A two-for-one twisting machine comprising:

a plurality of two-for-one twisting units arranged in rows, said two-for-one twisting units each having a twisting machine, at least one feed package and a take-up device, a travelling member adapted to travel in front of said plural two-for-one twisting units, said travelling member being provided with a main rod, a feed package changing device operable with the two-for-one twisting units, and a take-up package changing device operable with the two-for-one twisting units, wherein said feed package changing device comprises a tensor moving device, comprising:

a first support beam adapted to move up and down along the main rod the first support beam having a top end, a first arm supported slidable vertically relative to the main rod and rotatable on the main rod in the directions toward and away from the two-for-one twisting units, the first arm positioned below the first support beam and in a direction substantially perpendicular thereto, a first lever pivotally supported on the top end of the first arm at the intermediate portion thereof, a link arm pivotally supported with and connecting the top end of said first support beam and one end of said first lever, a driving means for driving the first arm, a rocking lever supported rockably by the first lever, two opposed chucks rockably supported by the first lever, the two opposed chucks being adapted to hold a tensor therebetween when the first arm is turned toward the two-for-one twisting units and to release a tensor held therebetween when the first arm is turned away from the two-for-one twisting units, and an opening/closing pin fixed to the rocking lever.

2. A two-for-one twisting machine, comprising:

a plurality of two-for-one twisting units arranged in rows, said two-for-one twisting units each having a twisting machine, at least one feed package and a take-up device, a travelling member adapted to travel in front of said plural two-for-one twisting units, said travelling member being provided with a main rod and a feed package changing device operable with the two-for-one twisting units, and a take-up package changing device operable with the two-for-one twisting units, wherein said feed package changing device has a package changing device comprising:

a support beam adapted to move up and down along the main rod, the support beam having a top end, an arm supported slidable vertically relative to the main rod and rotatable on the main rod, the arm having a front end, an exchange hand pivotally supported on the top end of the arm at the intermediate portion thereof, the arm being positioned below said support beam and in a direction substantially perpendicular thereto, a link arm pivotally supported with and connecting the top end of said support beam and one end of said exchange hand, and a driving means for driving the support beam and the arm.

3. The two-for-one twisting machine as claimed in claim 2, wherein said exchange hand comprises:

a rocking piece having an abutting piece formed integrally at the front end thereof and mounted on the arm, a pair of levers supported by the arm, each lever having a front end, a pair of cam followers pivotally supported at the front ends of the levers a shaft rotatably supported at the front end of the arm, a base plate fixed with the shaft, a restriction plate loosely fitted on the shaft and having a pin at one end thereof to which the link arm is connected, a cam plate fixed to the shaft and having a large-diameter portion and a smaller diameter portion abutting the cam followers, and a pair of chucks supported by the base plate.

4. The two-for-one twisting machine as claimed in claim 3, the two-for-one twisting machine being operable with a package having a guide pipe, wherein said shaft has a hollow portion, and wherein the exchange hand further comprises:

a slide pin arranged in the hollow portion, the slide pin having a lower end and an upper end, the upper end abutting the abutting piece of the rocking piece, and an abutting plate fixed at the lower end of the slide pin to operate the chucks by abutting with the chuck, wherein the slide pin is movable vertically with vertical movement of the abutting piece, to operate the chucks to grip and release the guide pipe.

5. The two-for-one twisting machine as claimed in claim 4, wherein the two-for-one twisting machine operates with a new feed package and an empty feed package, wherein said base plate is rotatable substantially 180°, and wherein the chucks are operated upon vertical movement of the second arm to exchange a new feed package and a guide pipe of an empty feed package at the same time.

6. A two-for-one twisting machine, comprising:

a plurality of two-for-one twisting units arranged in rows, said two-for-one twisting units each having a twisting machine, at least one feed package and a take-up device, a travelling member adapted to travel in front of said plural two-for-one twisting unit, said travelling member being provided with a feed package changing device operable with the two-for-one twisting units, and a take-up package changing device operable with the two-for-one twisting units, wherein said feed package changing device has a yarn end finding device, wherein said yarn end finding device comprises:

an upper arm, a box supported by the upper arm, the box having a side face a lower arm movable toward the two-for-one twisting units, a link mechanism movable toward the two-for-one twisting units, a connecting rod mounted to the side face of the box, a yarn end finding mouth fixed to the front end of the connecting rod, yarn conveying levers mounted to the side face of the box, and suction and expulsion means, operatively connected with the suction mouth, for providing a suction and blowoff of air pressure through the suction mouth.

7. A two-for-one twisting machine comprising:

a plurality of two-for-one twisting units arranged in rows, said two-for-one twisting units each having a twisting machine, at least one feed package and a take-up device, a travelling member adapted to travel in front of said plural two-for-one twisting units, said travelling member being provided with a feed package changing device operable with the two-for-one twisting units, and a take-up package changing device operable with the two-for-one twisting units, wherein said take-up package changing device comprises a fully wound package transfer device, a yarn end transferring device, an empty take-up tube feeder and a cradle arm moving device, the two for one twisting machine being operable with a take-up package supported by the cradle arm, wherein said fully wound package transfer device comprises:

a main rod secured with the machine frame, an arm supported by the main rod and pivotable relative to the main rod, the arm having a front end, a support member mounted to the front end of the arm, a link mechanism mounted to the front end of the arm, a guide plate fixed to the support member, said guide plate comprising a plate having a width at least corresponding to the take-up package width and bent guide portions which are bent vertically on both sides of the plate, an L-shaped supported by the arm, a push-out plate being supported on the arm through the L-shaped rod and arranged to abut the cradle arm to drop the full wound package from the cradle arm.

8. A two-for-one twisting machine, comprising:

a plurality of two-for-one twisting units arranged in rows, said two-for-one twisting units each having a twisting machine, at least one feed package and a take-up device, a travelling member adapted to travel in front of said plural two-for-one twisting units, said travelling member being provided with a feed package changing device operable with the two-for-one twisting units, and a take-up package changing device operable with the two-for-one twisting unit, wherein said take-up package changing device comprises a full wound package transfer device, a yarn end transferring device, an empty take-up tube feeder and a cradle arm moving device, wherein said yarn end transferring device comprises:

a bracket fixed to the machine frame, a first arm supported rotatably on the bracket, a second arm mounted rotatably on the first arm, the second arm having a front end portion, a link rod extending between the bracket and the second arm, and a yarn holding member mounted at the front end portion of the second arm.

9. The two-for-one twisting machine as claimed in claim 8, wherein said yarn holding member comprises:

a base plate fixed to the end of the second arm, the base plate having an end portion, a stationary blade fixed to the end portion of the base plate, a movable blade pivotally supported by the base plate, and a holding blade pivotally supported by the base plate and positioned with the movable blade for sandwiching the stationary blade therebetween.

10. A two-for-one twisting machine, comprising:

a plurality of two-for-one twisting units arranged in rows, said two-for-one twisting units each having a twisting machine, at least one feed package and a take-up device, a travelling member adapted to travel in front of said plural two-for-one twisting units, said travelling member being provided with a feed package changing device operable with the two-for-one twisting units, and a take-up package changing device operable with the two-for-one twisting units, wherein said take-up package changing device comprises a full wound package transfer device, a yarn end transferring device, an empty take-up tube feeder and a cradle arm moving device, wherein said empty take-up tube feeder comprises:

a shaft fixed to the machine frame, a first arm pivotally supported by the shaft, the first arm having a front end and a base end, a stationary pawl fixed to the front end of the first arm, a movable pawl pivotally supported by the front end of the first arm, a lever pivotally mounted to the base end portion of the first arm, the lever having a first end and a second end, a link rod connecting the first end of the lever and the movable pawl, a cam follower mounted on the second end of the lever, and a cam plate having a peripheral surface being in abutment with the cam follower, the cam plate being fixed to the shaft.

11. A two-for-one twisting machine, comprising:

a plurality of two-for-one twisting units arranged in rows, said two-for-one units each having a twisting machine, at least one feed package and a take-up device, a travelling member adapted to travel in front of said plural two-for-one twisting units, said travelling member being provided with a feed package changing device operable with the two-for-one twisting units, and a take-up package changing device operable with the two-for-one twisting units, wherein said take-up package changing device comprises a full wound package transfer device, a yarn end transferring device, an empty take-up tube feeder and a cradle arm moving device, wherein said cradle arm moving device comprises:

a rotatable driving shaft, a driven shaft, a plurality of link levers connecting the driving shaft with the driven shaft, a bracket mounted to the driven shaft, a first arm secured to the bracket, the first arm having a front end, a cradle arm opening member secured to the front end of the first arm in a position wherein the turning motion of the driving shaft opens the cradle arm by the cradle arm opening member.

12. A two-for-one twisting machine comprising:

a plurality of two-for-one twisting units arranged in rows, said two-for-one twisting units each having a twisting machine, at least one feed package and a take-up device, a travelling member adapted to travel in front of said plural two-for-one twisting units, said travelling member being provided with a feed package changing device operable with the two-for-one twisting units, and a take-up package changing device operable with the two-for-one twisting units, a rail disposed adjacent the two-for-one twisting units, wherein said travelling member comprises an automatic package changing machine movable along the rail and having a machine frame provided with an upper side and a lower side, wherein the feed package changing device and the take-up package changing device are provided on the lower and the upper side of a machine frame, respectively, wherein said feed package changing device comprises a tensor moving device, a package changing device and a yarn end finding device, wherein said two-for-one twisting units are arranged in two rows back to back and said travelling member is freely movable along and around the two rows of the two-for-one twisting units, a plate arranged adjacent an end of the rows of the two-for-one twisting units, said plate having a guide slot including a curvilinear and arcuate portion, wherein the travelling member includes a guide roller arranged to move along the guide slot.

13. A two-for-one twisting machine operable with a plurality of feed packages and a plurality of take-up packages, the two-for-one twisting machine comprising:

a plurality of two-for-one twisting units, each twisting unit being operable to wind yarn from one of the feed packages to one of the take up packages;

conveying means, arranged adjacent the twisting units, for conveying feed packages adjacent the twisting units;

a traveling member movable adjacent the conveying means and the twisting unit; and feed package changing means for replacing the feed packages from which the twisting units have wound yarn with feed packages conveyed by the conveying means, the feed package changing means being supported by the traveling member;

wherein the feed package changing means is movable with the traveling member adjacent the conveying means and the twisting units.

14. A two-for-one twisting machine as claimed in claim 13, wherein the two-for-one twisting machines is further operable with a plurality of empty take-up tubes to which yarn may be wound to form a plurality of take-up packages, the two-for-one twisting machine further comprising:

an empty take-up tube stocker adapted to store at least one empty take-up tube; and a take-up package changing means for replacing the take-up packages to which one of the twisting units have wound yarn with an empty take-up tube stored by the empty take-up tube stocker, the take-up package changing means being supported by the traveling member;

wherein the take-up package changing means is movable with the traveling member adjacent the conveying means and the twisting units.

15. A two-for-one twisting machine as claimed in claim 13, further comprising:

a rail disposed adjacent the two for one twisting units; and a rail abutting member supported by the traveling member and arranged to abut the rail upon movement of the traveling member adjacent the two-for-one twisting units.

16. A two-for-one twisting machine as claimed in claim 13, wherein the two-for-one twisting units are arranged in two rows in a back-to-back relationship, and the conveying means extends around the two rows of twisting units.

17. A two-for-one twisting machine comprising:

a plurality of two-for-one twisting units arranged in rows, said two-for-one twisting units each having a twisting machine, at least one feed package and a take-up device, a travelling member adapted to travel adjacent the plural two-for-one twisting units, said travelling member being provided with a main rod and a feed package changing device operable with the two-for-one twisting units, said feed package changing device having a tensor moving device comprising:

a first support beam adapted to move along the main rod, a first arm supported slidably relative to the main rod and rotatable on the main rod toward and away from the two-for-one twisting units, a first lever pivotally supported by the first arm, a link arm pivotally supported with and connecting the first support beam and one end of said first lever, a driving means for driving the first arm, a rocking lever supported rockably by the first lever, two opposed chucks rockably supported by the first lever, the two opposed chucks including holding means for holding a tensor therebetween when the first arm is turned toward the two-for-one twisting units and to release tensor held therebetween when the first arm is turned away from the two-for-one twisting units.

18. A two-for-one twisting machine comprising:

a plurality of two-for-one twisting units arranged in rows, each of said units having at least one feed package, a travelling member adapted to travel adjacent the plural two-for-one twisting units, said travelling member being provided with a main rod and a feed package changing device operable with the two-for-one twisting units, said feed package changing device having a package changing device comprising:

a support beam adapted to move along the main rod, an arm supported slidable relative to the main rod and rotatable on the main rod, an exchange hand pivotally supported on the arm, a link arm pivotally supported with and connecting the support beam and the exchange hand, and a driving means for driving the support beam and the arm.

* * * * *